US006417827B1

(12) United States Patent
Nagao et al.

(10) Patent No.: US 6,417,827 B1
(45) Date of Patent: Jul. 9, 2002

(54) LIQUID CRYSTAL DISPLAY DEVICE HAVING A WIDE DYNAMIC RANGE DRIVER

(75) Inventors: Shoji Nagao, Chiba; Takahiro Fujioka, Mobara; Mitsuru Goto, Chiba; Kazunari Saito, Mobara; Shinji Yasukawa, Shirako; Yozo Nakayasu; Kentaro Agata, both of Mobara, all of (JP)

(73) Assignees: Hitachi, Ltd., Tokyo; Hitachi Device Engineering Co., Ltd., Mobara, both of (JP)

( * ) Notice: Subject to any disclaimer, the term of this patent is extended or adjusted under 35 U.S.C. 154(b) by 0 days.

(21) Appl. No.: 09/493,272

(22) Filed: Jan. 28, 2000

(30) Foreign Application Priority Data

Feb. 26, 1999 (JP) ..... 11-050695

(51) Int. Cl.[7] ..... G09G 3/36

(52) U.S. Cl. ..... 345/89; 345/87; 345/90; 345/92; 345/93; 345/94; 345/96; 345/204; 345/209; 345/210; 345/211; 345/213; 349/42

(58) Field of Search ..... 345/87, 89, 90, 345/92, 93, 94, 204, 213, 210, 211, 209, 96; 349/42

(56) References Cited

U.S. PATENT DOCUMENTS 5,995,073 A * 11/1999 Isami et al. ..... 345/89
6,144,373 A * 11/2000 Nakazawa et al. ..... 345/204
6,211,866 B1 * 4/2001 Okutani ..... 345/209

* cited by examiner

*Primary Examiner*—Richard Hjerpe
*Assistant Examiner*—Jean Lesperance

(57) ABSTRACT

A MOS transistor (M1) which is arranged in the highest order of a low Vth MOS transistor grayscale group of a decoder circuit of a drain driver is formed of a CMOS transistor, to prevent a current from flowing from an output side into the low Vth MOS transistor portion owing to a grayscale voltage applied to another portion.

7 Claims, 37 Drawing Sheets

LIQUID CRYSTAL DISPLAY DEVICE HAVING A WIDE DYNAMIC RANGE DRIVER

BACKGROUND OF THE INVENTION

1. Field of the Invention

The present invention relates to a liquid crystal display device and, more particularly, to an art useful in application to video signal line driving means of a liquid crystal display device capable of providing multilevel grayscale display.

2. Description of the Related Art

Liquid crystal display devices are widely used as display devices for OA equipment such as personal computers. The liquid crystal display devices are mainly classified into a simple matrix type in which pixels are formed at the intersections of stripe-shaped electrodes disposed to intersect with one another, and an active matrix type which has an active element such as a thin-film transistor (TFT) for each pixel and turns on and off the active element.

The active matrix type of liquid crystal display device includes a TFT liquid crystal panel, scanning signal line driving means and video signal line driving means for supplying a scanning voltage and a video signal voltage, respectively, to scanning signal lines (gate lines) and video signal lines (drain lines) all of which are disposed over this liquid crystal panel, and a display control unit as well as an internal power supply circuit for supplying various control signals and display data outputted from a host side such as a personal computer, to the scanning signal line driving means and the video signal line driving means as displaying signals.

FIG. 28 is a schematic block diagram illustrating the construction of a liquid crystal display device to which the present invention is applied. A liquid crystal panel 281 which constitutes this liquid crystal display device is a thin-film transistor type of active matrix liquid crystal display device (TFT-LCD), and a plurality of video signal line driving circuits (hereinafter referred to also as drain drivers) 282 and a plurality of scanning signal line driving circuits (hereinafter referred to also as gate drivers) 283 are arranged over the top side of the liquid crystal panel 281.

The liquid crystal panel 281 is made of, for example, 1024×768 picture elements (pixels: Pix) each of which is formed by three color pixels of red (R), green (G) and blue (B).

A control signal, which is made of three color display data (video signals) for red (R), green (G) and blue (B), a clock signal, a display timing signal and a synchronizing signal all of which are outputted from the host side such as a personal computer, is inputted to a display control device 285 via an interface connector 284.

The display control device 285 generates display data of a form displayable on the liquid crystal panel on the basis of the control signal, and supplies the display data to the drain drivers 282 via a data bus. At the same time, the display control device 285 supplies timing signals, (a carry input, CLK1, CLK2) such as a display start timing clock, a line clock and a pixel clock to the drain drivers 282.

An internal power supply circuit 286 generates a reference voltage (V9 to V0) for producing a display grayscale and supplies the reference voltage to the drain drivers 282, and also applies a scanning voltage (a gate voltage) to the gate drivers 283.

Each of the drain drivers 282 is assigned to a predetermined number of video signal lines (drain lines), and is arranged to serially give a carry output to the next drain driver after a predetermined number of counts.

Each of the drain drivers 282 is provided with a grayscale generation circuit for generating a grayscale voltage corresponding to display data for the drain lines and an amplifying circuit for amplifying the generated grayscale voltage and outputting a video signal voltage corresponding to the display data to each of the drain lines.

In addition, in the TFT type of liquid crystal display device, to prevent burn-in on a liquid crystal layer, the grayscale voltage to be applied to the drain lines needs to be inverted in polarity with respect to a counter electrode (hereinafter, VCOM) for each frame. As methods of realizing this, there are VCOM alternating current driving which varies the polarity of the counter electrode as well, and dot inversion driving which varies the drain lines to a great extent with the counter electrode being retained in a fixed potential.

This kind of driving of a liquid crystal display device is disclosed in, for example, Japanese Patent Laid-Open No. 281930/1997.

SUMMARY OF THE INVENTION.

In recent years, the trend in TFT types of active matrix liquid crystal display devices has been toward larger screen sizes in liquid crystal panels (TFT-LCD), higher resolution, higher image quality and lower power consumption. In addition, in order to omit a useless space and improve the appearance of a display device, it has been demanded that the size of its frame portion be made as small as possible.

In other words, as the market becomes more mature, it is becoming more indispensable to lower the prices of liquid crystal display devices, and further reductions in the mounting areas of drain drivers as well as reductions in the sizes of frame portions are demanded. In addition, as notebook personal computers become more widely used, the necessity for long-time driving using batteries increases and lower power consumption in liquid crystal display devices is demanded.

As described above, a grayscale voltage to be applied to a drain line needs to be inverted in polarity with respect to the voltage VCOM of a counter electrode for each frame. However, while the gate voltage of a TFT is changing from its on state to its off state, the gate-fo-source capacitance (Cgs) of the TFT assumes a depletion state, so that the voltage applied to the liquid crystal, i.e., the output voltage of a drain driver penetrates into this depletion portion.

Therefore, for example if the TFT is of an n type, the voltage at the gate electrode is lower during the off state than during the on state, so that since a positive voltage penetrates into a drain side, an effective voltage to be applied to the liquid crystal is lower than the output of the drain driver. Accordingly, in view of this penetration, in the n-type of TFT, it is necessary that during the application of a negative side (a low voltage side) relative to VCOM, the output voltage of the drain driver be made higher than the voltage required in the absence of the penetration.

For the above-described reason, to equalize the effective voltages of negative and positive sides relative to VCOM, it is necessary to adopt asymmetric driving in which the output voltage of the drain driver is asymmetric with respect to VCOM between the negative side (low voltage side) and the positive side (high voltage side).

In a dot inversion driver, a reductions in chip size is needed by disposing low-voltage-dedicated circuits and high-voltage-dedicated circuits, respectively, by numbers each equal to not the total number of output terminals but ½ of the same, by taking advantage of the fact that a negative side (a to voltage side) and a positive side (a high voltage side) are alternately outputted from adjacent output terminals.

Since the construction of the low-voltage-dedicated circuits and the high-voltage-dedicated circuits (a decoder construction) aims at reducing chip size, it is necessary that the switching elements of grayscale voltage selection circuits, amplifier circuits and output selection circuits be formed of only NMOSs for the low-voltage-dedicated circuits as well as of only PMOSs for the high-voltage-dedicated circuits so that the number of elements can be reduced.

FIGS. 29 to 32 are circuit diagram illustrating specific examples of the constructions of a low-voltage-dedicated circuit and a high-voltage-dedicated circuit of a drain driver. FIGS. 29 and 30 show the low-voltage-dedicated circuit, while FIGS. 31 and 32 show the high-voltage-dedicated circuit. Incidentally, each pair of FIGS. 29 and 30 and FIGS. 31 and 32 show the corresponding circuit in the form of two divided sections, because both circuits have fine constructions. Circled numbers (1), (2), . . . denote lines which are respectively connected to each other between FIGS. 30 and 31 and between FIGS. 31 and 32. These circuits constitute an example of the construction of a drain driver capable of providing 64-level grayscale display.

In the low-voltage-dedicated circuit and the high-voltage-dedicated circuit shown in FIGS. 29 to 32, display data are inputted to input terminals D0P, D0N, D1P, D1N, . . . D5P and D5N and to input terminals D0PH, D0NH, D1PH, D1NH, . . . D5PH and D5NH, and 64 grayscale levels arc inputted to V00, V01, . . . V63 and to VH00, VH01, . . . VH63, respectively. Incidentally, a substrate bias BG of the circuit shown in FIGS. 29 and 30 is connected to ground (GND), while a substrate bias BG of the circuit shown in FIGS. 31 and 32 is connected to a power source (VLCD).

Negative-side (low-voltage-side) and positive-side (high-voltage-side) drain line driving voltages are outputted at output terminals YB and YA, respectively.

FIGS. 33 to 36 are circuit blocks illustrating other specific examples of the constructions of a low-voltage-dedicated circuit and a high-voltage-dedicated circuit of a drain driver. FIGS. 33 and 34 show the low-voltage-dedicated circuit, while FIGS. 35 and 36 show the high-voltage-dedicated circuit. Incidentally, similarly to each pair of FIGS. 29 and 30 and FIGS. 31 and 32, each pair of FIGS. 33 and 34 and FIGS. 35 and 36 show the corresponding circuit in the form of two divided sections, because both circuits have fine constructions. Circled numbers (1), (2), . . . denote lines which are respectively connected to each other between FIGS. 33 and 34 and between FIGS. 35 and 36. These circuits also constitute an example of the construction of a drain driver capable of providing 64-level grayscale display.

In the low-voltage-dedicated circuit and the high-voltage-dedicated circuit shown in FIGS. 33 to 36, display data are inputted to input terminals D1P, D0N, D0P, D1N, D3P, D2N, D2P, D3N, D5P, D4N, D4P and D5N and to input terminals D1PH, D0NH, D0PH, D1NH, D3PH, D2NH, D2PH, D3NH, D5PH, D4NH, D4PH and D5NH, and 64 grayscale voltages are inputted to V00, V01, . . . V63 and to VH00, VH01, . . . VH63, respectively.

Incidentally, a substrate bias BG of the circuit shown in FIGS. 33 and 34 is connected to ground (GND), while a substrate bias BG of the circuit shown in FIGS. 35 and 36 is connected to a power source (VLCD).

Negative-side (low-voltage-side) and positive-side (high-voltage-side) drain line driving voltages are outputted at output termminals YB and YA, respectively.

However, the maximum voltage selectable by the switching elements (NMOSs and PMOSs) which constitute the above-described drain driver depends on a threshold (Vth) determined by the substrate bias effect of a MOS which selects the highest grayscale level with respect to a substrate potential reference. For example, in the case of the NMOSs which constitute the circuit shown in FIGS. 29 and 30, letting VLCD stand for a voltage to be applied to a liquid crystal, i.e., the output voltage of the drain driver; Vmax the maximum selectable voltage; and (Vth0+ΔVth) the threshold voltage at the time of Vmax output, the following expression (1) is given:

$$VLCD-V\max=Vth0+\Delta Vth. \quad (1)$$

This leads to the problem that as the voltage VLCD is made lower, the maximum selectable voltage becomes smaller.

In the expression (1), VLCD represents the liquid crystal driving voltage, Vth0 represents Vth for a substrate bias of "0", and ΔVth (V) represents an increase in Vth for a substrate bias of V.

In addition, if the output voltage of the drain driver is to be formed by the above-described asymmetric driving, there is the problem that the maximum selectable voltage becomes small on a side of polarity which widens its output voltage range, for example, on a negative side in an n-type of TFT.

Furthermore, although the output voltage range of the drain driver can be widened by forming the above-described switching elements as complementary MOSs (CMOSs), the chip area of the drain driver increases, and in a grayscale level selection circuit in particular, as the number of grayscale levels becomes larger, the influence of the increase in the chip area becomes larger and hinders the development of multilevel grayscale display. This increase in the chip area is a large obstacle to reductions in the frame sizes and the prices of liquid crystal display devices.

In addition, in an amplifier circuit and an output selection circuit of the low-voltage-dedicated circuit (low voltage decoder) and the high-voltage-dedicated circuit (high voltage decoder), it is necessary to widen their operating voltage ranges.

FIG. 37 is a circuit diagram illustrating a differential input portion which constitutes an amplifier circuit of a low-voltage-dedicated circuit of a related-art drain driver. A high-voltage-dedicated circuit also has a similar circuit. This differential input portion (chopper circuit) is made of only NMOSs which are respectively surrounded by circles in FIG. 37 (a differential input portion which constitutes an amplifier of a high-voltage-dedicated circuit is made of only PMOSs.)

FIG. 38 is a circuit diagram of an output selection circuit for selecting either one of the amplifier circuit output of the low-voltage-dedicated circuit or the amplifier circuit output of the high-voltage-dedicated circuit. This output selection circuit (output selector circuit) determines whether each of the amplifier circuit output, YH, of the high-voltage-dedicated circuit and the amplifier circuit output, YL, of the low-voltage-dedicated circuit should be outputted to YA or YB via a PMOS transistor (YH) or an NMOS transistor (YL) in accordance with selection signals (selector signals) ACKOP and ACKEN.

The maximum operating voltage in the circuit shown in FIGS. 37 and 38 depends on the threshold Vth determined by the substrate bias effect of each MOS switch. The maximum operating voltage Vmax is given by the following expression (2):

$$VLCD-V\max>Vth0+\Delta Vth\ (V\max). \quad (2)$$

However, there is the problem that when Vmax=VLCD/2, an on-resistance (Ron) increases and a normal voltage cannot be outputted.

In a liquid crystal display device, gate drivers and an interface part are mounted on lateral sides of the screen of its liquid crystal panel, and drain drivers are mounted on the top or bottom side of the screen. In a dot inversion driving type of liquid crystal display device, each drain driver is provided with an output circuit for outputting a positive voltage and a negative voltage, and internal signals are switched therebetween by a polarity inverting signal, thereby effecting an output polarity inverting operation.

This output polarity inverting operation, switchover between input pixel data is effected in units of pixels (for example, 6 bits) (for example, D00–D05 (Y2n) ←→D10–D15 (Y2n+1), and a switchover line is needed in a related-art circuit.

This leads to the problem that the switchover line for pixel data inputs across a reference voltage input terminal and a control signal input terminal from the pad arrangement of the chip of the drain driver cannot effectively utilize a layout space owing to a power source line, a center buffering circuit and the like, so that a desired chip size cannot be achieved.

FIG. 39 is a block diagram illustrating the construction of a drain driver, which includes first data latch circuits 401, control circuits 1, a buffer circuit, data switchover circuits 403, second data latch circuits 45, a voltage dividing circuit 6, level shifter circuits 9, a decoder circuit 7, an amplifier circuit (amplifying circuit) 8 and an amplifier output switchover circuit (amplifying circuit output switchover circuit) 11.

Normally, during an output polarity inverting operation, display data input signals are switched therebetween (in units of 2 pixels×6 bits) by polarity inverting signals, and amplifier output signals are switched therebetween in units of 2 outputs.

FIG. 40 is a circuit diagram of a related-art display data switchover circuit, which outputs the outputs of the display data input part 401 having first data latch circuits for latching input display data 1 and 2 to either of data lines 404 or 405 via a switchover line 402 and the switchover circuits 403.

This circuit adopts a CMOS type of multiplexer to which polarity inverting signals and a pair of display data inputs which determine an output-on state are inputted in units of 2 pixels×1 bit. This circuit is needed in the form of 6 pixels×6 bits.

FIG. 41 is a wiring diagram of the chip of the drain driver, and the input lines of the switchover circuit occupy an area of 2 pixels×6 bits×(line width+line pitch).

In the switchover between display data inputs across the control signal input terminals and the reference voltage input terminals, the input lines of the switchover circuit needs to be arranged in such a manner as to avoid a power source line for the reference voltage input terminals and an internal control signal buffering circuit. This fact leads to the problem of increasing the area of the input lines of the switchover circuit to a further extent.

Moreover, to reduce a variation in a liquid crystal driving voltage output from an output amplifier circuit, as described previously, the polarity of an output voltage variation component is inverted and canceled in synchronism with a display frame period or the like by a chopper circuit, whereby an effective variation is reduced.

FIG. 42 is a block diagram illustrating the arrangement of a test terminal in a related-art drain driver. The chip of the drain driver is provided with amplifier circuits 423(1, 2, . . . (n−1), n) which include built-in chopper circuits, respectively. Mounted on the chip are a chopper control signal generation circuit 421 for generating a control signal on the basis of, for example, a display frame period (frame start signal) of a liquid crystal panel, a level shifter circuit 422, the n number of amplifier circuits 423 which include built-in chopper circuits, respectively. A liquid crystal driving voltage output terminal 424 and a test terminal 425 are also formed on the chip.

It is important to make an inspection as to whether each of the chopper circuits for inverting the polarities of output voltage variation components normally operates. Since these variation components are minute, a chopper control signal to be supplied to the chopper circuits of the amplifier circuits is connected to the test terminal and a test is equivalently performed.

However, in the case of the related-art chip, since the test terminal 425 is arranged in the chip center portion, it is difficult to guarantee that the chopper control signal reaches an amplifier circuit located at a chip end.

In addition, since a frame start signal input terminal is arranged at only one location on the chip, in the case of a mounting package, such as a tape carrier package (TCP), which uses a one-layer metal interconnection or the like, the arrangement of pins on the package are limited by the arrangement of terminals on the chip, so that the frame start signal input terminal is allowed to be present at only one fixed location on the package.

In addition, in different liquid crystal display devices, there are some cases where different pin arrangements on TCPs are required for liquid crystal drivers having the same function, in terms of a problem such as the design of printed circuit boards. In this case, according to the related art, it is necessary to re-design chips having different pin arrangements, so that development costs and development periods become problems. In addition, there is the problem that the number of kinds of articles to be produced increase and a reduction in manufacturing cost due to a mass-production effect cannot be achieved.

Furthermore, in the related-art chip, the test terminal for the chopper control signals of the chopper circuits is arranged on only the side of the liquid crystal driving voltage output terminal connected to the liquid crystal panel, and a test of each of the chopper circuits is carried out with a probe inspection.

However, if such a chip is to be mounted on a liquid crystal panel in the state of being incorporated in a package such as a TCP, it is often impossible to lead out of the package the test terminal arranged on the side of the liquid crystal driving voltage output terminal of the chip, because limitations are imposed on the layout of lines of the liquid crystal driving voltage output terminal.

In case that a test terminal cannot be arranged on a package, there is the problem that it is impossible to detect a defective chopper control signal due to the assembly of the package.

The present invention is to solve the various problems of the above-described related art, and a first object of the present invention is to provide a liquid crystal display device in which the image quality of a liquid crystal panel can be made high by widening the liquid crystal driving voltage output range of each of a low-voltage-dedicated circuit and a high-voltage-dedicated circuit which are incorporated in a drain driver.

Another object of the present invention is to provide a liquid crystal display device in which a liquid crystal driving voltage VLCD is lowered by widening the liquid crystal driving voltage output range of a drain driver, whereby the overall power consumption can be reduced.

Another object of the present invention is, to provide a liquid crystal display device in which the liquid crystal driving voltage output range of a drain driver is widened with an increase in chip area being restrained, whereby its frame size and price can be reduced.

Another object of the present invention is to provide a liquid crystal display device in which an inspection can easily be made as to whether the chopper control signal of a drain driver reaches an amplifier circuit located at a chip end, and it is possible to easily guarantee that the chopper control signal reaches the amplifier circuit, whereby a variation in liquid crystal driving voltage output is reduced to improve display quality.

Another object of the present invention is to provide a liquid crystal display device in which one chip can deal with different packages having different pin positions for frame start signals of drain drivers whereby a development cost for chip and an increase in the number of type to be produced can be reduced.

Another object of the present invention is to provide a liquid crystal display device in which it is possible to comprehensively guarantee a frame start signal input and the operation of a chopper signal generation circuit even after the packaging of a drain driver.

Representative constructions of the present invention for achieving the above-described objects will be described below in brief.

(1) A liquid crystal display device is comprising: a liquid crystal panel having a plurality of scanning signal lines and a plurality of video signal lines and a liquid crystal panel having a plurality of pixels to which video signal voltages corresponding to A number of pieces of display data are to be applied via the video signal lines by a plurality of video signals; and-video signal line driving means for supplying to the video signal lines the video signal voltages corresponding to the A number of pieces of display data, the video signal line driving means having: a power source circuit for outputting K number of grayscale reference voltages; a plurality of grayscale generation circuits for generating grayscale voltages corresponding to the A number of pieces of display data, for the respective video signal lines; and a video signal line driving circuit made of a plurality of amplifier circuits and output selecting circuits for amplifying the grayscale voltages and outputting video signal voltages corresponding to the display data to the respective video signal lines, the video signal lines driving means including: grayscale voltage generation means for dividing the K number of grayscale reference voltages outputted from the power source circuit to generate M-level grayscale voltages and selecting one of the generated grayscale voltages; and output means for making maximum output levels for N grayscale levels out of the M grayscale levels greater than maximum output levels for the other (M–N) grayscale levels, the grayscale voltage generation means being a grayscale voltage selection circuit having switching elements corresponding to the A number of pieces of display data; among switching elements for selecting display data for the N grayscale levels, switching elements corresponding to the B number of pieces of display data among the A number of pieces of display data having the switching characteristics of being turned on or off at all the N grayscale levels, and on-resistances of switching elements corresponding to (A–B) number of pieces of display data being smaller than on-resistances of switching elements for selecting display data for the (M–N) grayscale levels.

(2) The liquid crystal display device described in the above paragraph (1) is characterized in that the switching elements corresponding to the B number of pieces of display data are CMOS transistors.

(3) The liquid crystal display device described in the above paragraph (1) or (2) is characterized in that threshold voltages of the switching elements corresponding to the (A–B) number of pieces of display data are smaller than threshold voltages of the switching elements for selecting display data for the (M–N) grayscale levels.

(4) The liquid crystal display device described in the above paragraph (1) is characterized in that each of the amplifier circuits includes a switching clement for effecting switchover between an input part and an output part, the switching element for effecting switchover between the input part and the output part being a switching element capable of outputting an output level not lower than the maximum output levels for the N grayscale levels.

(5) The liquid crystal display device described in the above paragraph (4) is characterized in that the switching element for effecting switchover between the input part and the output part is a CMOS transistor.

(6) The liquid crystal display device described in the above paragraph (4) is characterized in that each of the output selection circuits includes a switching element capable of outputting an output level not lower than the maximum output levels for the N grayscale levels.

(7) The liquid crystal display device described in the above paragraph (6) is characterized in that each of the output selection circuits is a CMOS transistor.

(8) The liquid crystal display device described in the above paragraph (1) is characterized in that the video signal line driving means outputs a positive video signal driving voltage and a negative video signal driving voltage at the time of each output, and two switchover circuits capable of generating positive, negative and output-off states of two different pieces of display data are used, the outputs of these two switchover circuits being connected to one data line in a switched manner.

(9) The liquid crystal display device described in the above paragraph (8) is characterized in that the circuit construction of (8) is used and another control input terminal and a reference voltage input terminal are arranged between display data input terminals which are laterally uniformly arranged on a chip.

(10) The liquid crystal display device described in the above paragraph (1) is characterized in that an inspection terminal for an internal control signal to be supplied to the amplifier circuits is arranged at an end of a control signal line.

(11) The liquid crystal display device described in the above paragraph (10) is characterized in that the internal control signal is connected to the inspection terminal through an output circuit for improving the capability to drive an external load.

(12) The liquid crystal display device described in the above paragraph (10) is characterized in that the output from a circuit for generating the internal control signal is connected to an arbitrary position on a signal line which propagates the internal control signal, and the inspection terminal is arranged at each of a plurality of ends of the internal control signal line.

(13) The liquid crystal display device described in the above paragraph (10) is characterized in that the output from a circuit for generating the internal control signal is connected to one end of a signal line which propagates the internal control signal, and the inspection terminal is arranged at the other end of the signal line.

(14) The liquid crystal display device described in the above paragraphs (9) to (13) is characterized in that frame start signal input terminals are arranged at a plurality of positions on the chip.

(15) The liquid crystal display device described in the above paragraphs (9) to (14) is characterized in that an input terminal for the internal control signal is arranged on an input terminal side in addition to a liquid crystal driving output terminal side.

According to the above-described constructions, it is possible to obtain a liquid crystal display device which enables higher image quality, lower power consumption, suppression of an increase in chip area, a smaller frame size and a lower price.

The present invention is not limited to any of the above-described constructions, and also encompasses constructions which will be disclosed in the following description of embodiments of the invention. In addition, various modifications of the present invention can be made without departing from the technical concepts disclosed in the above-described constructions and the embodiments of the invention.

DESCRIPTION OF THE PREFERRED EMBODIMENTS

Embodiments in which the present invention is applied to a so-called TFT type of active matrix liquid crystal display device will be described below in detail with reference to the accompanying drawings.

Embodiment 1

Figure 1:
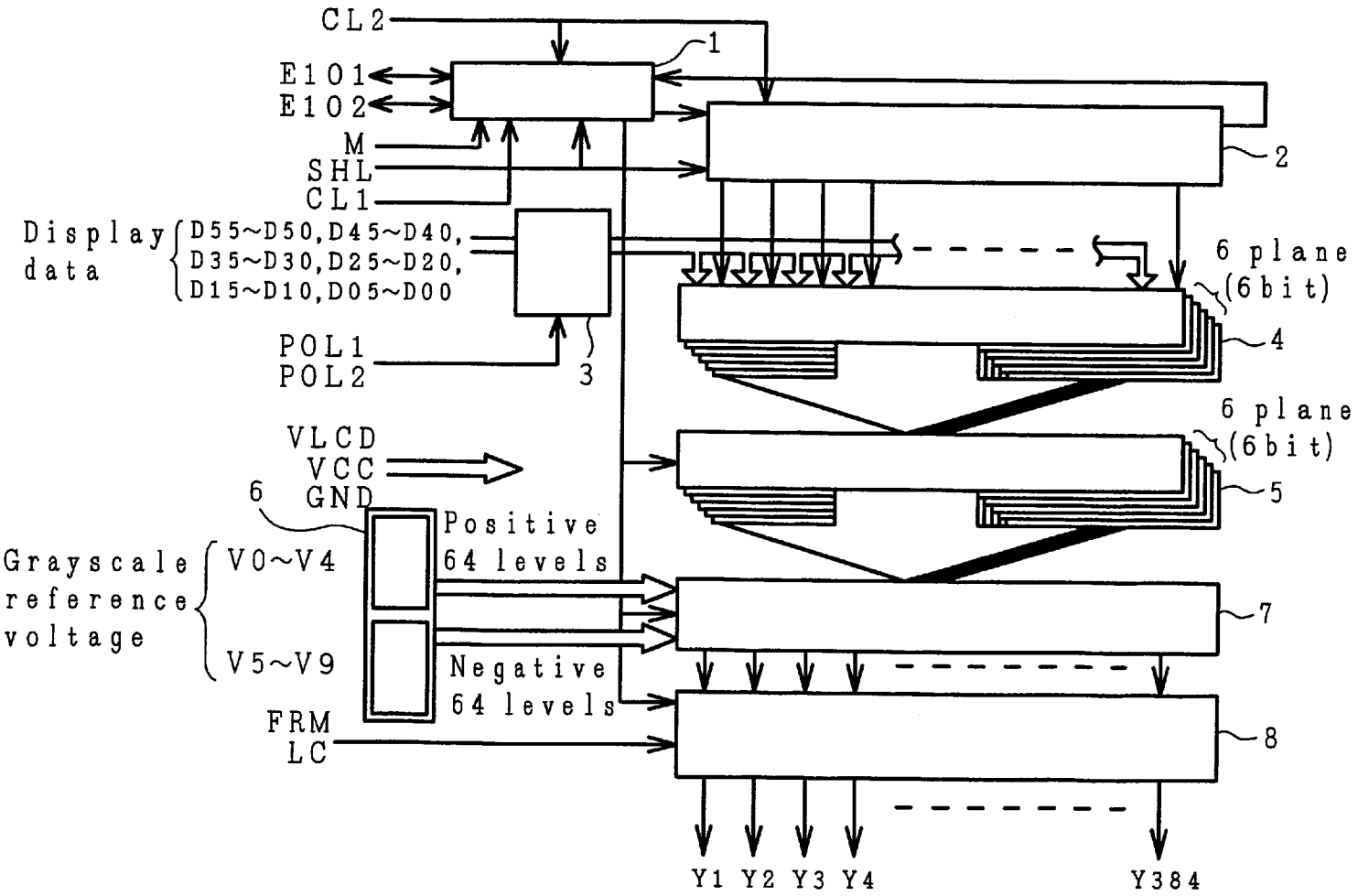
FIG. 1 is a block diagram illustrating the construction of a drain driver of a TFT type of active matrix liquid crystal display device according to a first embodiment of the present invention.

FIG. 1 is a block diagram illustrating the construction of a drain driver of a TFT type of active matrix liquid crystal display device according to one embodiment of the present invention.

As one example, FIG. 1 shows the construction of a 64-gray-level, 384-output driver for 6-bit display data which is made of a clock control circuit 1, a latch address selector 2, a data inverting circuit 3, a first latch circuit 4, a second latch circuit 5, a grayscale level generation circuit 6, a decoder (a grayscale level selection circuit) 7 and an output amplifier circuit 8. Incidentally, symbols CL1, CL2, FRMLC, EI01, EI02, M, SHL, POL1 and POL2 denote various kinds of clocks and control signals, and symbols VLCD, VCC and GND denote various kinds of operating voltages.

The first latch circuit 4 and the second latch circuit 5 are each made of 6 bits (64 levels)×384, and thc decoder 7 outputs 384 pieces of decoded data, and the output amplifier circuit 8 outputs 384 pieces of display data (Y1 to Y384).

The present embodiment adopts an asymmetric driving system in which positive 64 levels and negative 64 levels are independently generated in a chip as grayscale voltages on the basis of grayscale reference voltages V0 to V4 and V5 to V9 by the grayscale voltage generation circuit 6 and these levels are supplied to the decoder 7.

Display data (D55-D50, D45-D40, D35-D30, D25-D20, D10-D10 and D05-D00) are inputted to the first latch circuit 4 through the data inverting circuit 3, and are latched (held) by the latch address selector 2 controlled by the pixel clock CL2.

The display data held in the first latch circuit 4 is inputted to the decoder 7 via the second latch circuit 5 by the line clock CL1 synchronized with one scanning line of the liquid crystal panel.

This decoder 7 selects a grayscale level which is generated by the grayscale voltage generation circuit 6 according to the inputted display data, and inputs the grayscale voltage to the output amplifier circuit 8. The output amplifier circuit 8 performs current amplification of the inputted grayscale voltage and generates drain driver outputs Y1 to Y384 to be inputted to the drain lines of the display panel, and writes voltage levels to pixels on the basis of these outputs.

Figure 2:
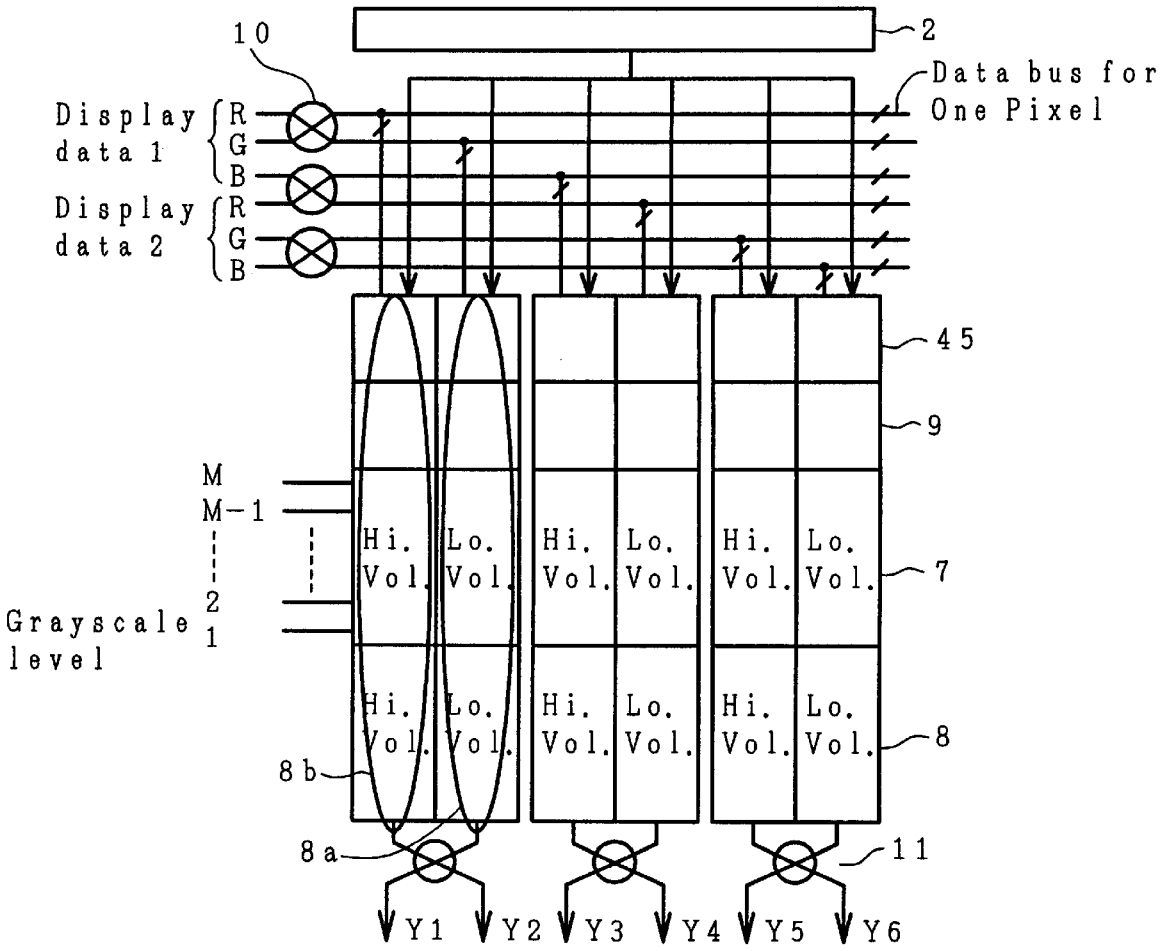
FIG. 2 is an explanatory view of the internal circuit of the drain driver of the first embodiment of the present invention.
Figure 3:
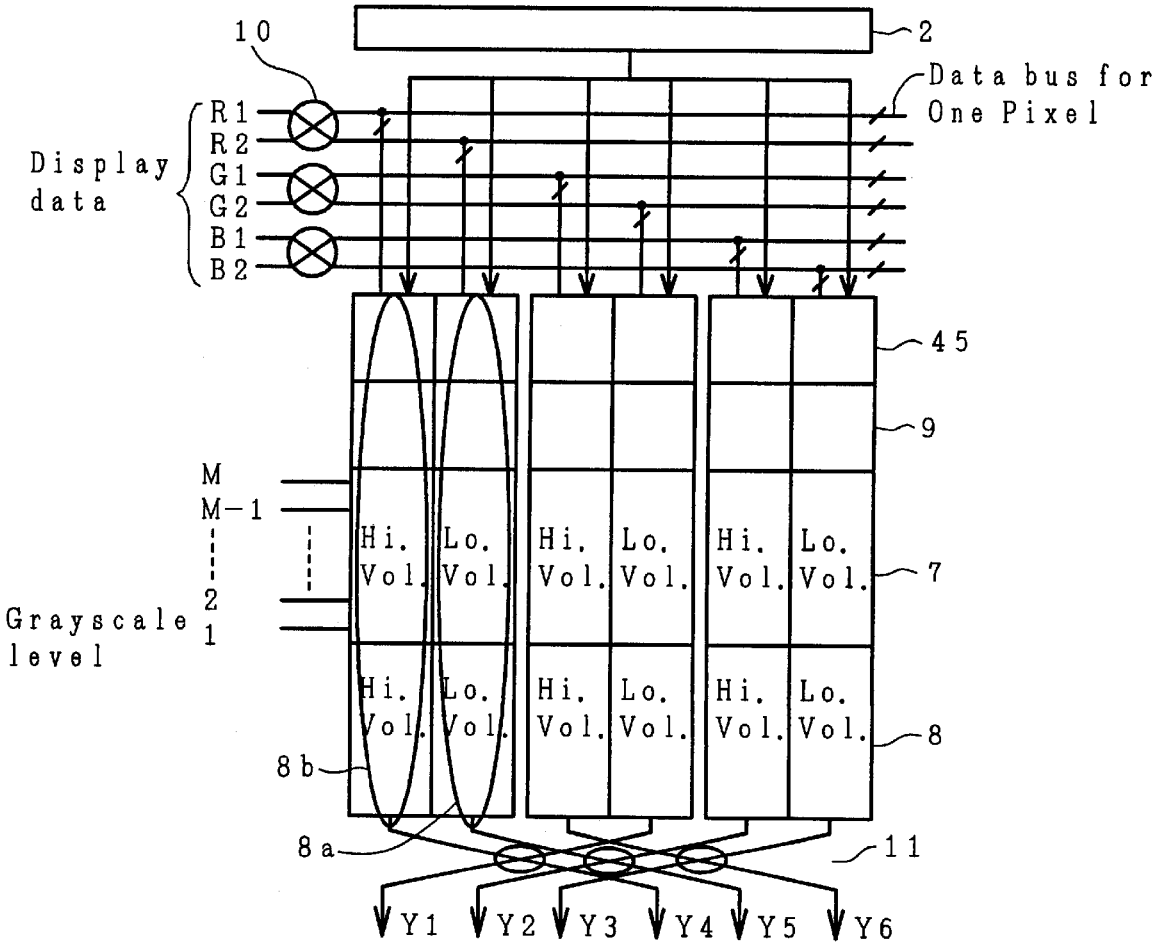
FIG. 3 is an explanatory view of the internal circuit of the drain driver of the first embodiment of the present invention.

FIGS. 2 and 3 are explanatory views of an internal circuit of the drain driver of the present embodiment. In FIGS. 2 and 3, functional portions identical to those shown in FIG. 1 are denoted by reference numerals identical to those used in FIG. 1, and reference numeral 45 denotes the first latch circuits 4 and 5 shown in FIG. 1, reference numeral 8*a* a low-voltage-dedicated circuit, reference numeral 8*b* a high-voltage-dedicated circuit, reference numeral 9 a level shifter circuit, reference numeral 10 a display data multiplexer, and reference numeral 11 an output selection circuit (an output multiplexer).

In the dot inversion driving system, as shown in FIGS. 2 and 3, the low-voltage-dedicated circuits 8*a* and the high-voltage-dedicated circuits 8*b* are respectively provided by numbers each equal to not the total number of output terminals but ½ of the same, by taking advantage of the fact that a negative voltage (a low voltage) and a positive voltage (a high voltage) are alternately outputted from adjacent output terminals, whereby a reduction in chip size is realized.

In addition, to realize dot inversion driving, the display data multiplexers 10 and the output multiplexers 11 which switch over display data between the low-voltage-dedicated circuits 8*a* and the high-voltage-dedicated circuits 8*b* are provided before and after the low-voltage-dedicated circuits 8*a* and the high-voltage-dedicated circuits 8*b*.

Each of the low- and high-voltage-dedicated circuits can employ similar circuits as the latch circuit 45 and the level shifter circuit 9, respectively. The decoders circuit 7 of the low- and high-voltage-dedicated circuits employ dedicated circuits, respectively, to realize a reduction in chip size.

Figure 4:
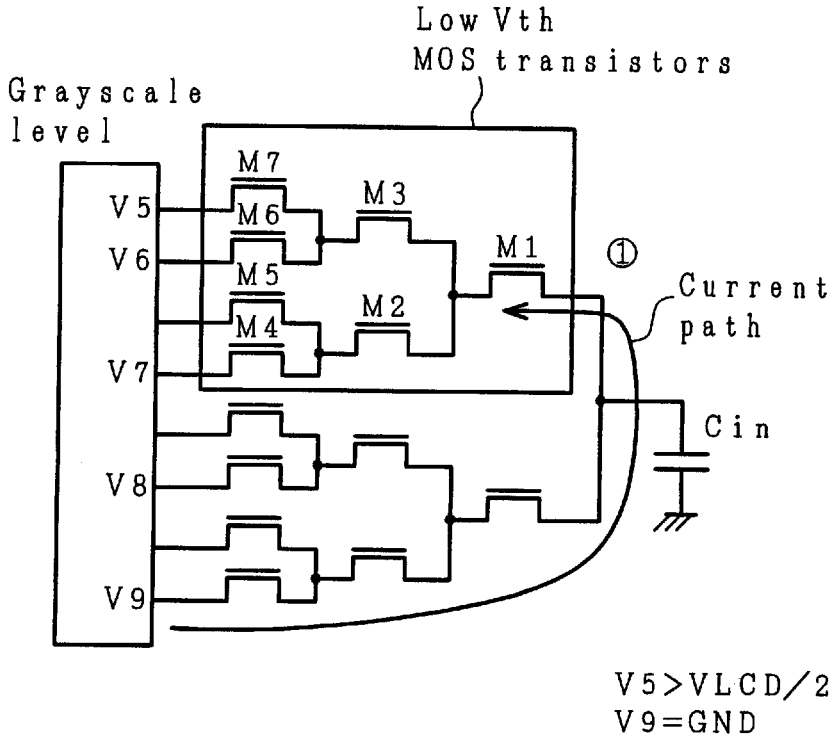
FIG. 4 is a schematic construction diagram illustrating a related-art example of a decoder circuit which constitutes a drain driver.
Figure 5:
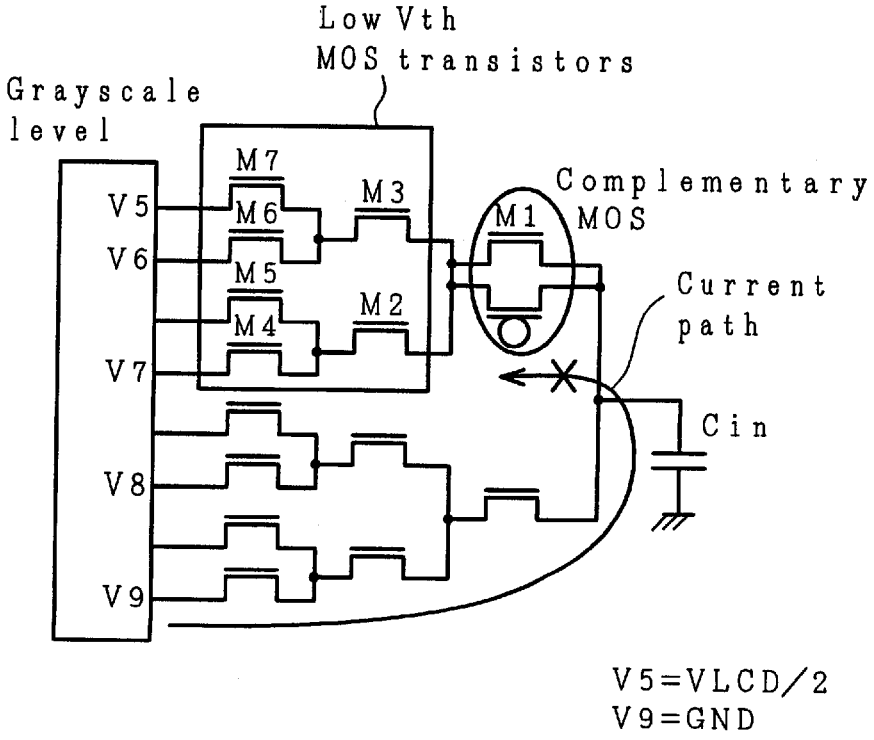
FIG. 5 is a schematic construction diagram illustrating a decoder circuit of the first embodiment of the present invention.

FIG. 4 is a schematic construction diagram illustrating a related-art example of a decoder circuit which constitutes a drain driver. FIG. 5 is a schematic construction diagram illustrating the decoder circuit of the present embodiment. Each of the decoders circuit is a tournament type decoder circuit which gradually decreases the number of grayscale levels to be selected, from its lower-order bit to its higher-order bit.

Incidentally, for case of understanding of the invention, FIGS. 4 and 5 to be referred to in the following description of the embodiment show the essential circuit of the embodiment in simple form. Actually, it goes without saying that in the case of, for example, a 64-gray-level display, MOS transistors are needed by a number which enables election of 64 gray levels.

In the low voltage decoder shown in FIG. 4, to widen its selectable voltage range, the relevant MOS transistors (the portion surrounded by fine solid lines in FIG. 4) are lowered in Vth so that the previously-described expression (1) can be satisfied even if a substrate bias occurs. This construction can be realized by selectively changing a Vth control ion implantation value by means of a mask and lowering Vth0.

However, in the circuit construction shown in FIG. 4, when a substrate bias is not applied to the low Vth MOS transistors, the low Vth MOS transistors become extremely low Vth or depression MOS (DMOS) transistors so that the low Vth MOS transistors can be set to an appropriate Vth when the substrate bias is applied.

For example, in the circuit of FIG. 4, when the level V9 of the substrate voltage is selected, a node (1) goes to a bias potential by means of the current path indicated by an arrow, so that a substrate bias effect does not occur in a MOS transistor M1 and the MOS transistor M1 is turned on. Accordingly, the level V9 and the levels V5 to V7 are shorted via the decoder circuit, and a normal voltage cannot be supplied to the amplifying circuit.

Therefore, in the present embodiment, in the low voltage decoder circuit shown in FIG. 5, the MOS transistor M1 which corresponds to the highest-order display data bit of the low Vth grayscale group is formed of a CMOS transistor.

In this manner, the MOS transistor M1 of FIG. 4 is formed of a CMOS transistor as shown in FIG. 5, whereby the MOS transistors can be reliably turned on and off at all grayscale levels. Accordingly, it is possible to prevent a current from flowing from an output side into the low Vth portion owing to a grayscale voltage applied to another portion.

Figure 6:
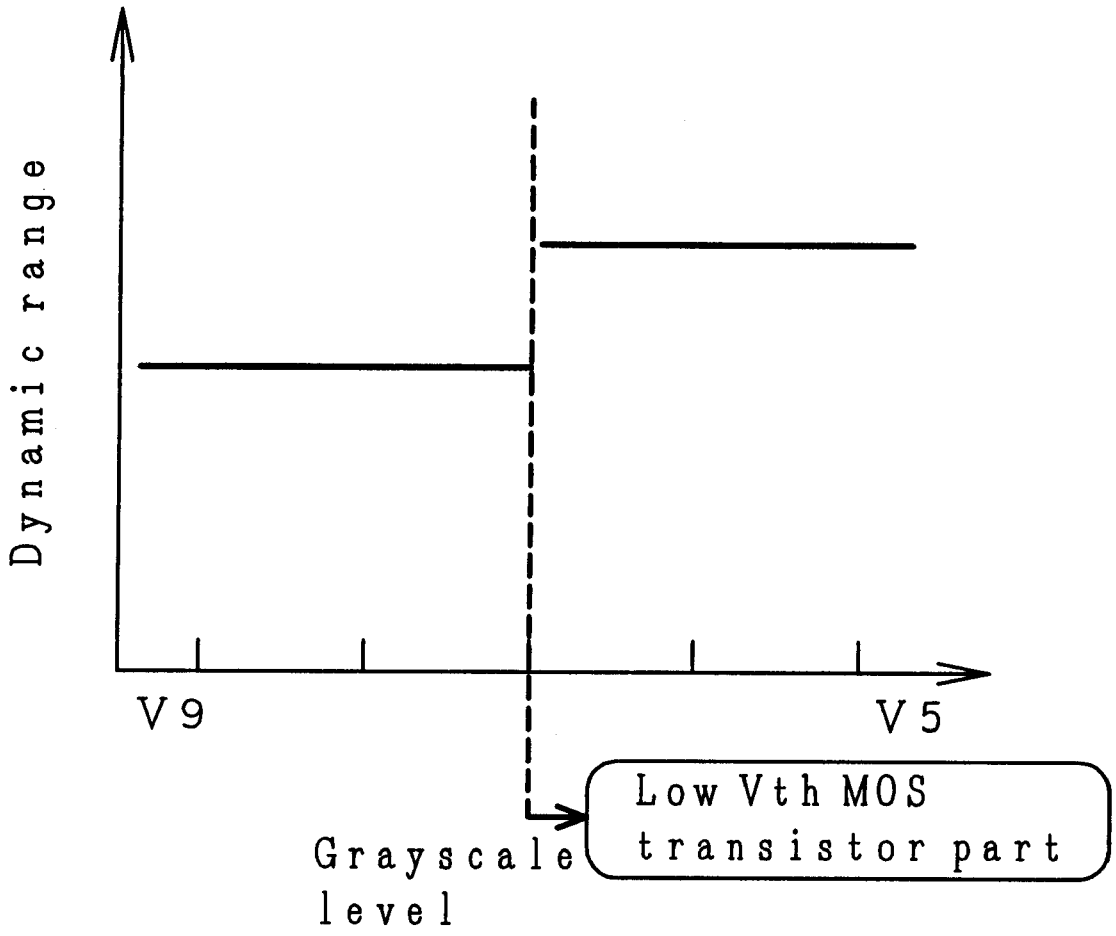
FIG. 6 is a view illustrating an output voltage range in the first embodiment of the present embodiment.

FIG. 6 is an explanatory view of an output voltage range in the present embodiment. The horizontal axis represents graysscale voltage (V9 to V5), and the vertical axis represents output voltage range. As shown in FIG. 6, the output voltage range against the grayscale voltages V5 to V7 can be made wider than the output voltage range against the grayscale voltages V8 and V9 by an amount equivalent to the amount of lowering in Vth of the MOS transistors M2 to M7 of FIG. 5.

In addition, even if the drain driver output voltage VLCD is made lower than a related-art one, it is possible to cover an output voltage range equivalent to a related-art one, whereby it is possible to reduce the power consumption of the liquid crystal display device due to the lowering of the drain driver output voltage VLCD.

In addition, since only one MOS transistor is added to the related-art circuit shown in FIG. 4, there is almost no increase in the area of the decoder circuit portion, and although the output voltage range is widened, there is no problem which hinders a reduction in the width of the frame of the liquid crystal display device and a reduction in the cost per chip.

Since the low Vth MOS transistors need to be enhancement MOS transistors at V7 which is the lowest grayscale level of V5 to V7, the lowering in Vth is adjusted by adjusting the amount of the corresponding Vth control ion implantation.

Figure 7:
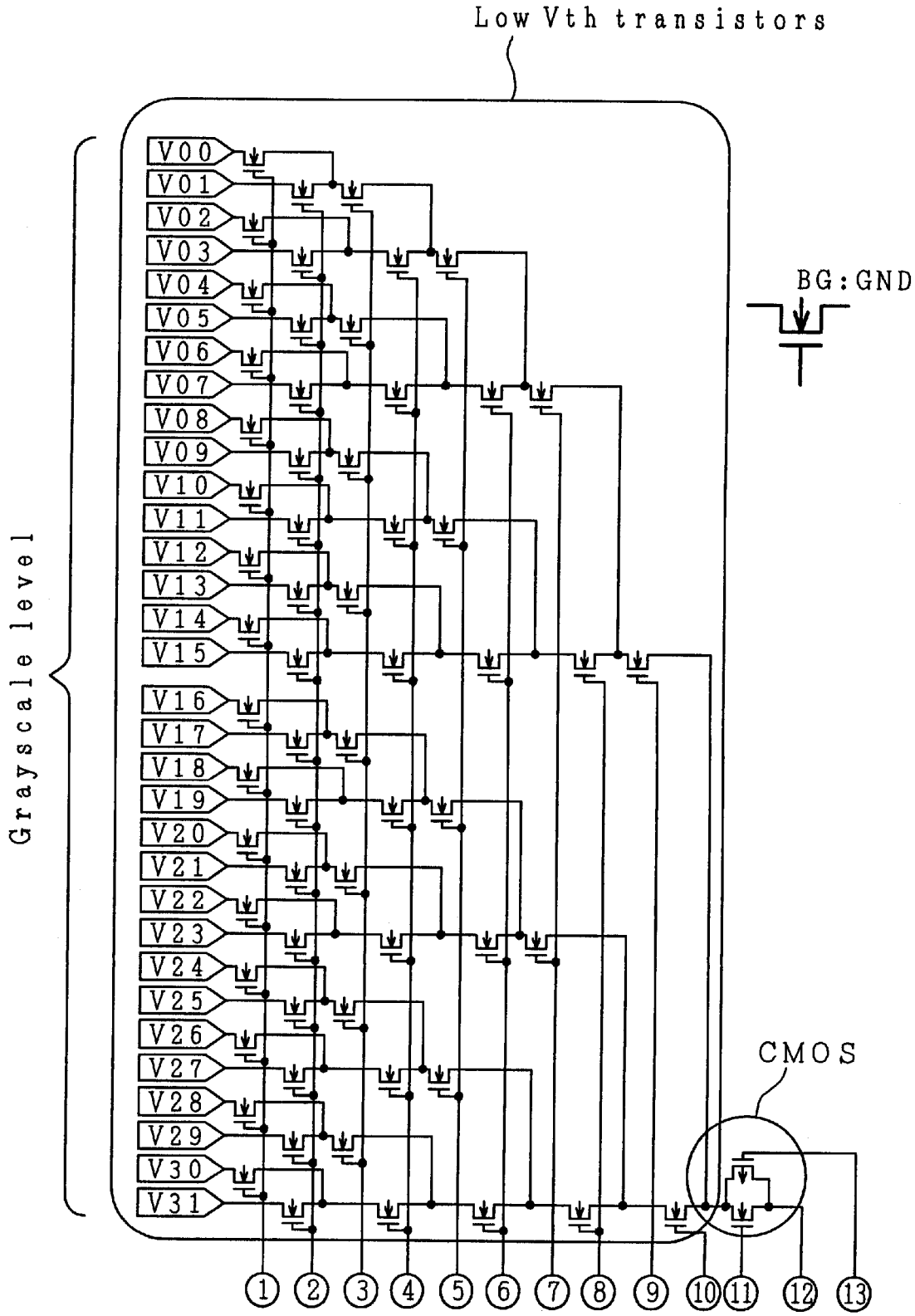
FIG. 7 is a specific partial circuit diagram of a low voltage decoder of the decoder circuit of the first embodiment of the present invention.
Figure 8:
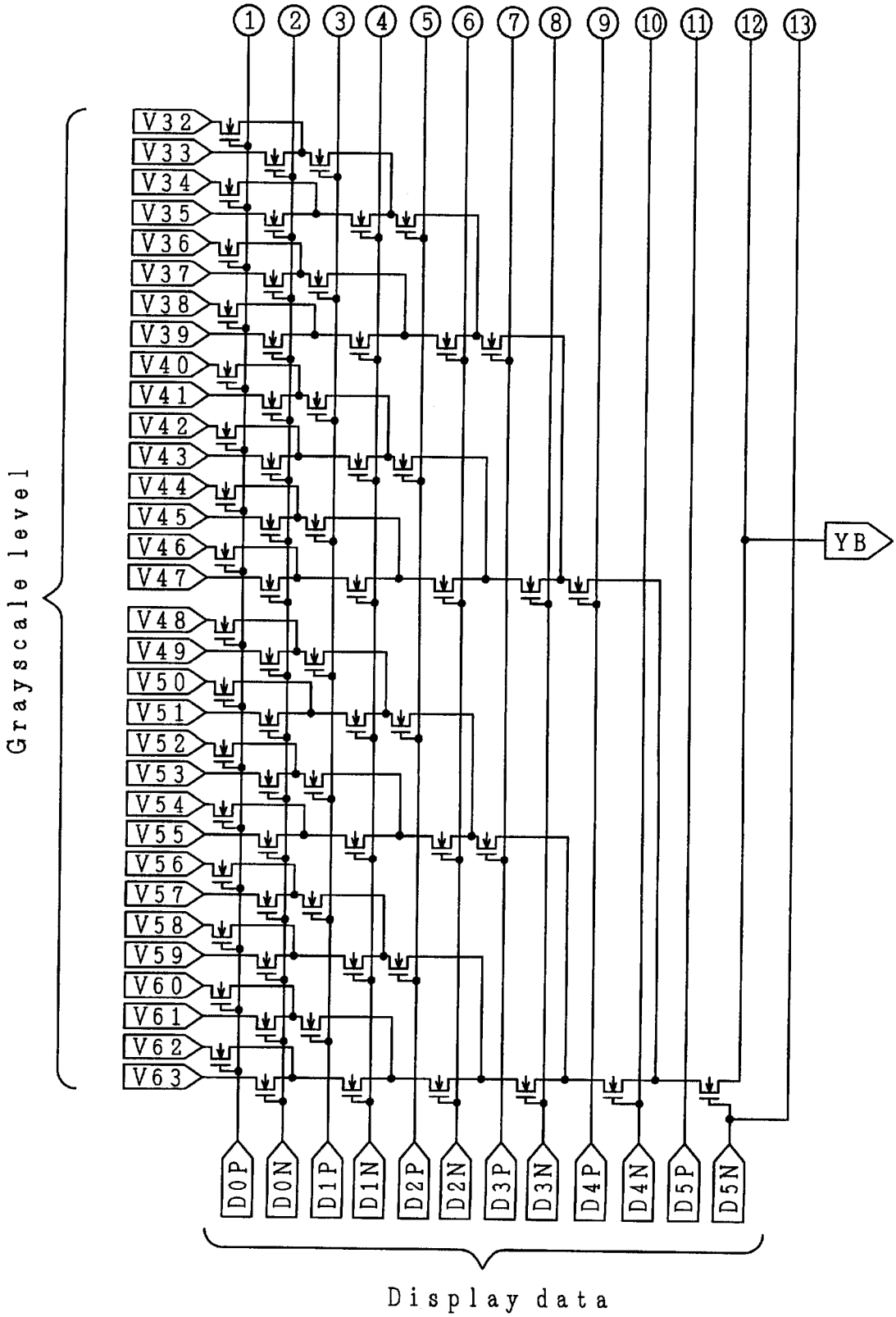
FIG. 8 is a partial circuit diagram illustrating one specific circuit along with FIG. 7 showing the low voltage decoder of the decoder circuit of the first embodiment of the present invention.
Figure 9:
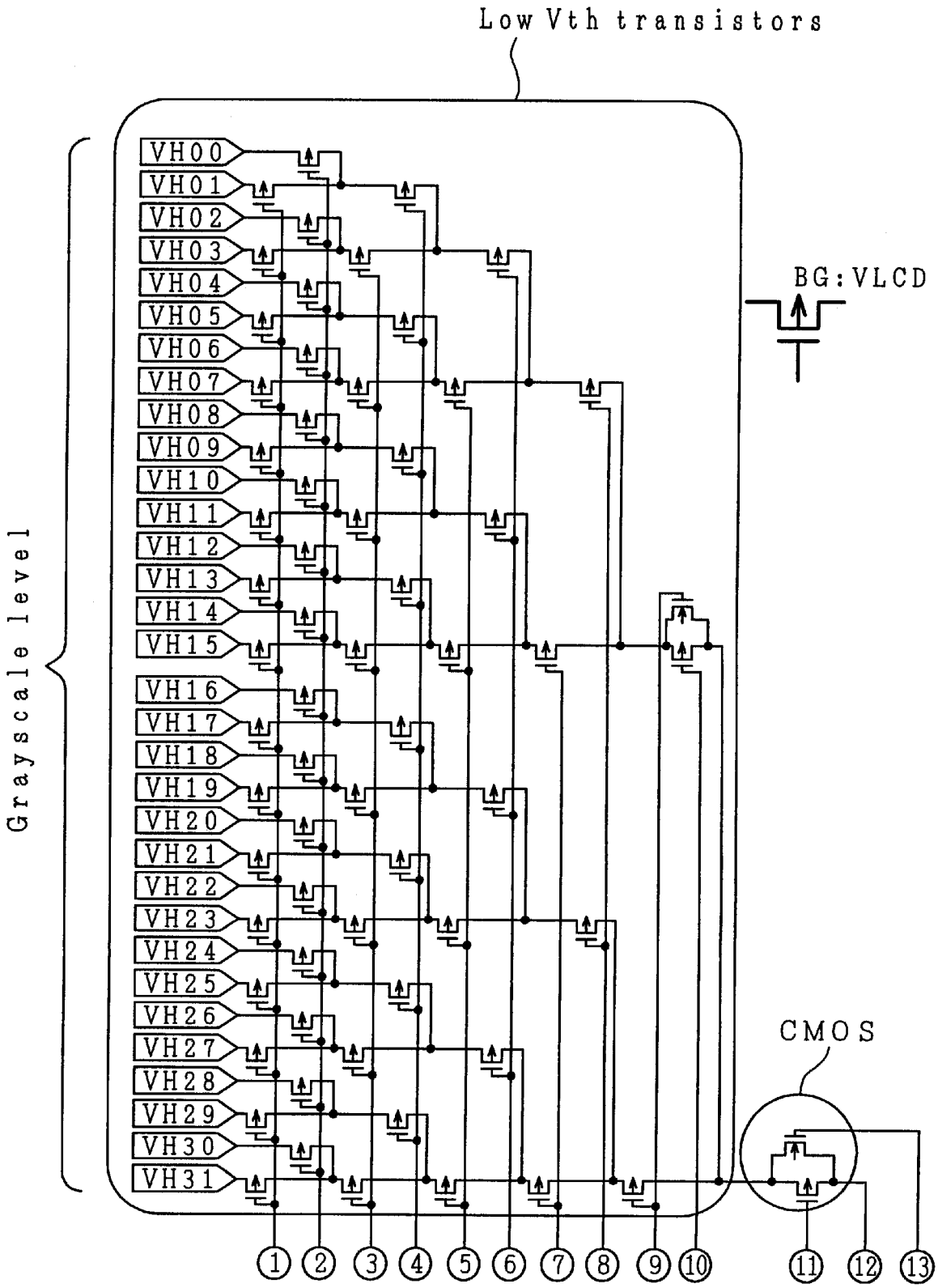
FIG. 9 is a specific circuit diagram of a high voltage decoder of the decoder circuit of the first embodiment of the present invention
Figure 10:
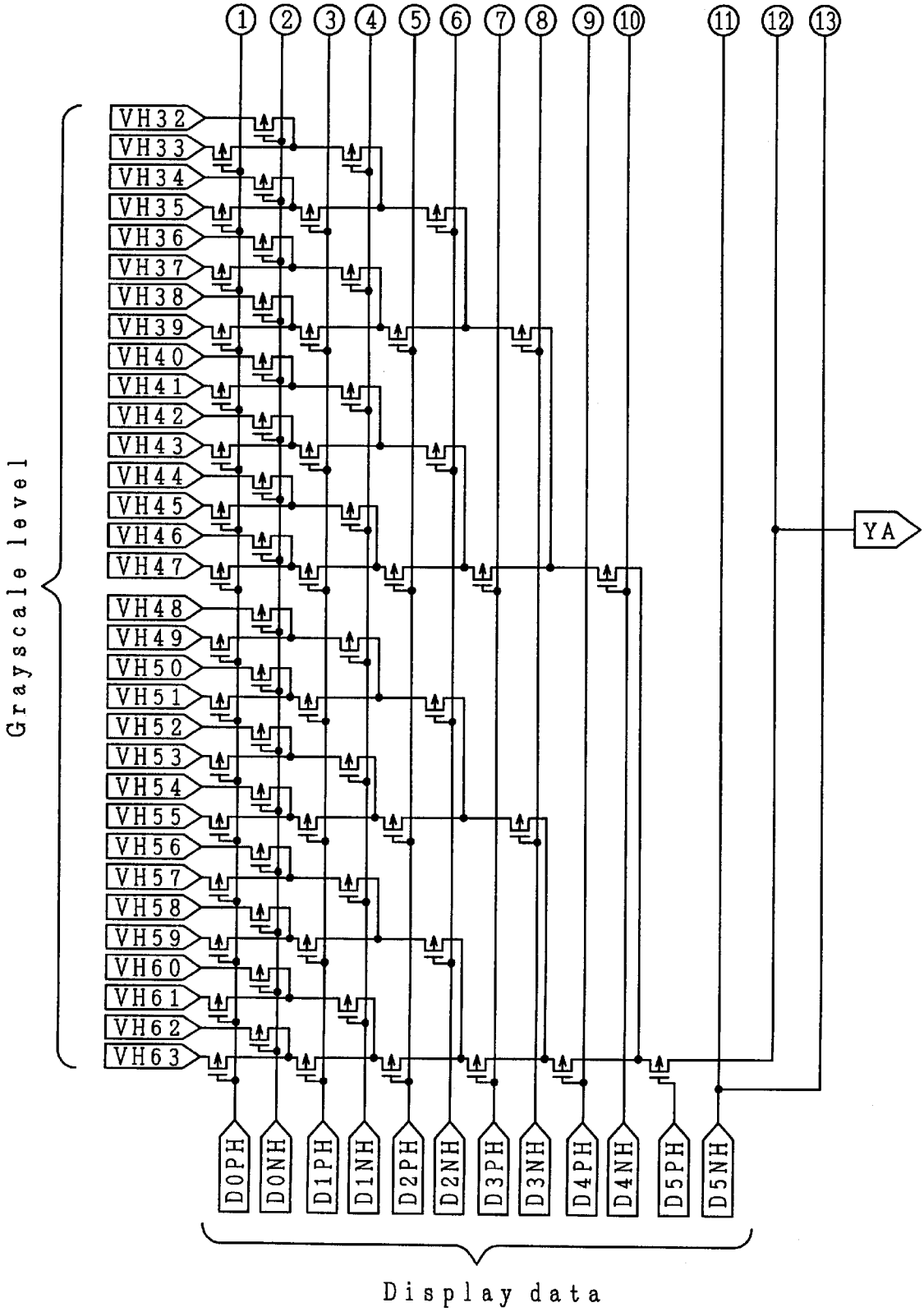
FIG. 10 is a partial circuit diagram illustrating one specific circuit along with FIG. 9 showing the high voltage decoder of the decoder circuit of the first embodiment of the present invention.

FIGS. 7 and 8 are specific circuit diagrams of a low voltage decoder of the decoder circuit of the present embodiment. FIGS. 9 and 10 are specific circuit diagrams of a high voltage decoder of the decoder circuit of the present embodiment. In FIGS. 7 and 8 and FIGS. 9 and 10, circled numerals denote lines which are connected to one another.

Embodiment 2

Figure 11:
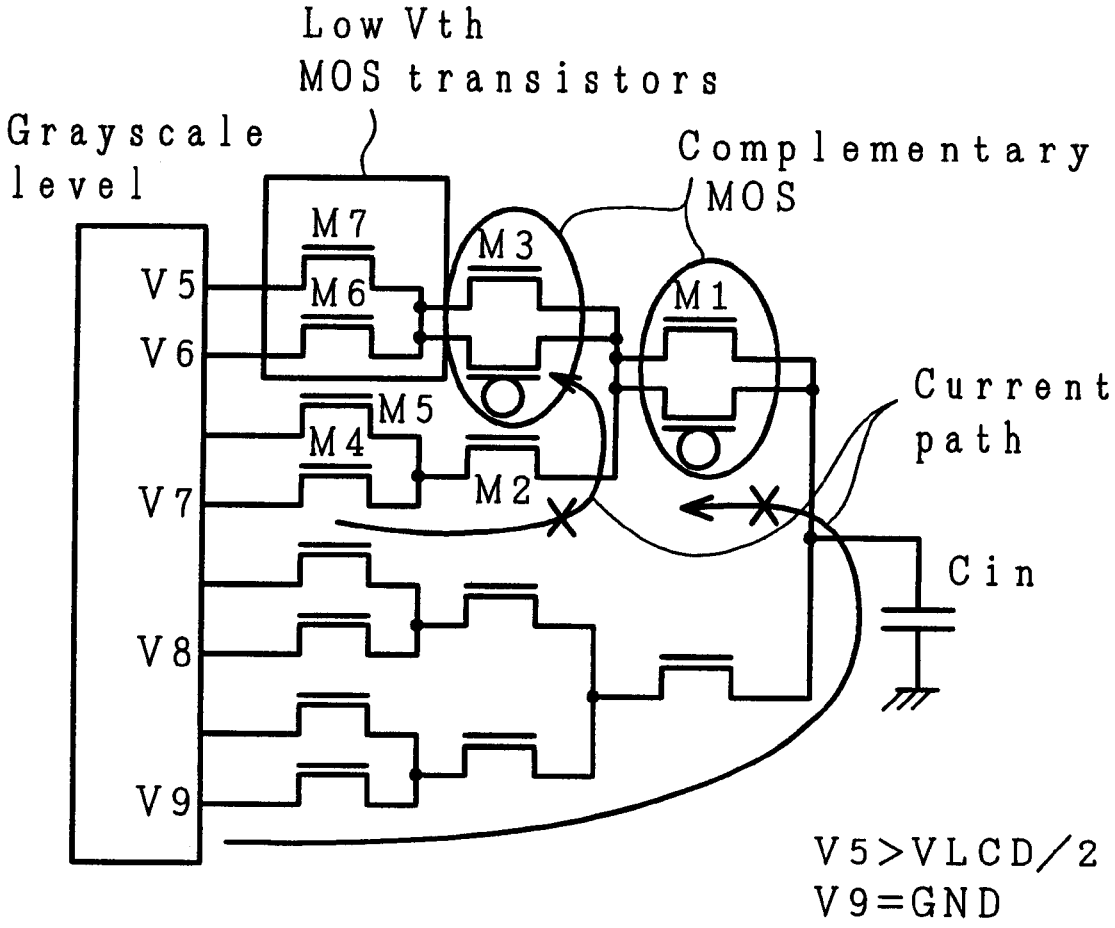
FIG. 11 is a schematic construction diagram illustrating a low voltage decoder circuit of a decoder circuit of a second embodiment of the present invention.

FIG. 11 is a schematic construction diagram illustrating a low voltage decoder of a decoder circuit of the present embodiment. Similarly to the one described above with reference to FIG. 5, this decoder circuit is also a tournament type decoder circuit which gradually decreases the number of grayscale levels to be selected, from its lower-order bit to its higher-order bit.

Incidentally, for ease of understanding of the invention, FIG. 11 to be referred to in the following description of the present embodiment shows the essential circuit of the embodiment in simple form. Actually, it goes without saying that in the case of, for example, a 64-gray-level display, MOS transistors are needed by a number which enables selection of 64 gray levels.

In the present embodiment, the MOS transistors M1 and M3 which correspond to the highest-order and the next-order display data bits of a low Vth grayscale group are formed of CMOS transistors, respectively. By forming the MOS transistors M1 and M3 as CMOS transistors, similarly to the above-described embodiment 1, the MOS transistors can be reliably turned on and off at all grayscale voltages, whereby it is possible to prevent a current from flowing from an output side into the low Vth portion indicated by an arrow in FIG. 11, owing to a grayscale voltage applied to another portion.

In the above-described embodiment 1, the low Vth MOS transistors need to be enhancement MOS transistors at V7, but in the present embodiment the low Vth MOS transistors need only to be enhancement MOS transistors at V6.

Accordingly, normal NMOS transistors can be used on condition that when a target output voltage range (reference voltage: V5) is set, the voltage level of V7 is within a range which can be sufficiently outputted from the normal NMOS transistors.

In this case, a substrate bias larger than that applied to the MOS transistor M7 of Embodiment 1 is applied to the low Vth MOS transistor M6, and the low Vth MOS transistor M6 is prevented from easily becoming a DMOS transistor when a grayscale voltage is inputted, whereby it is possible to increase the margin of Vth-lowering control.

Figure 12:
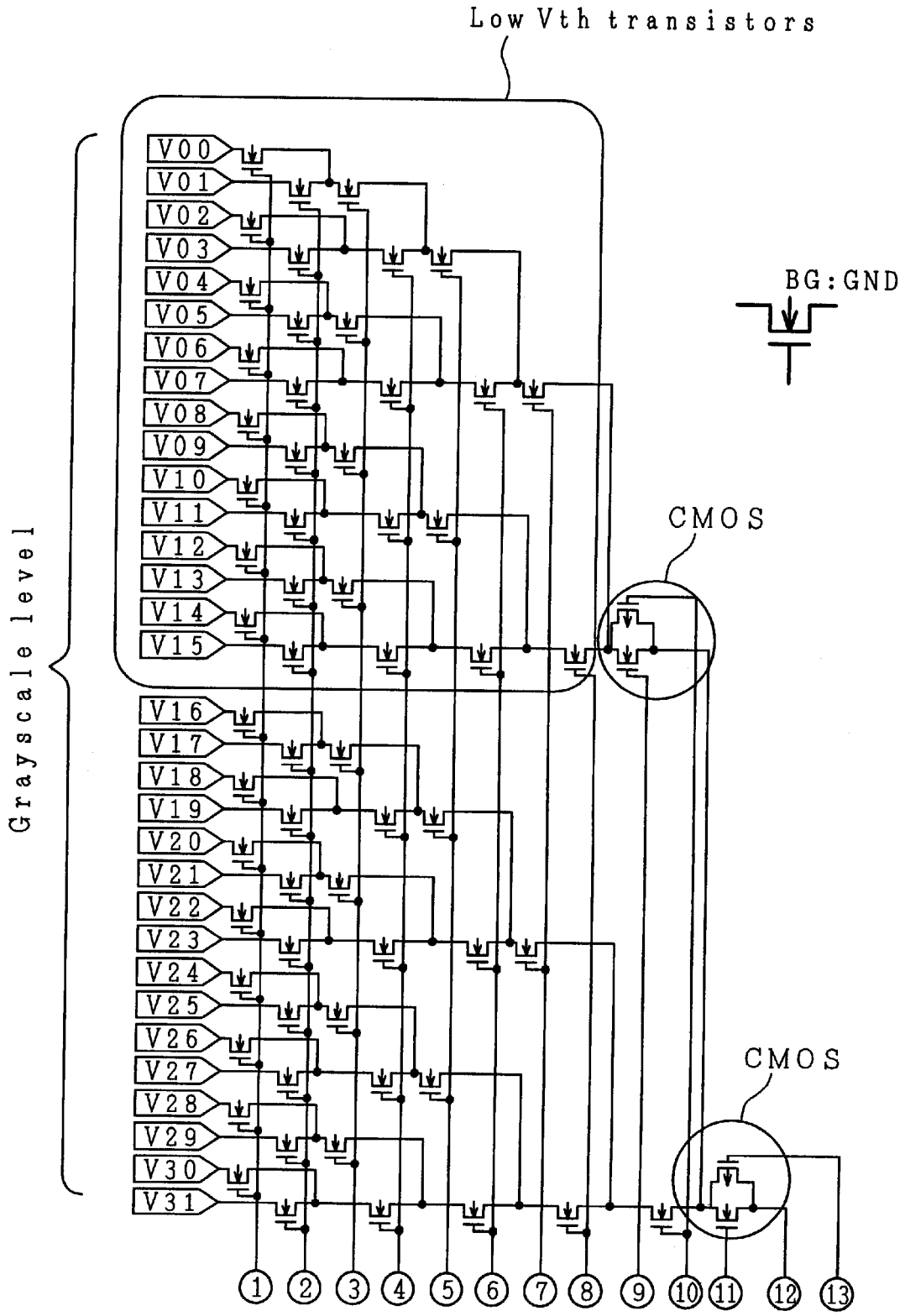
FIG. 12 is a specific circuit diagram of the low voltage decoder of the decoder circuit of the second embodiment of the present invention.
Figure 13:
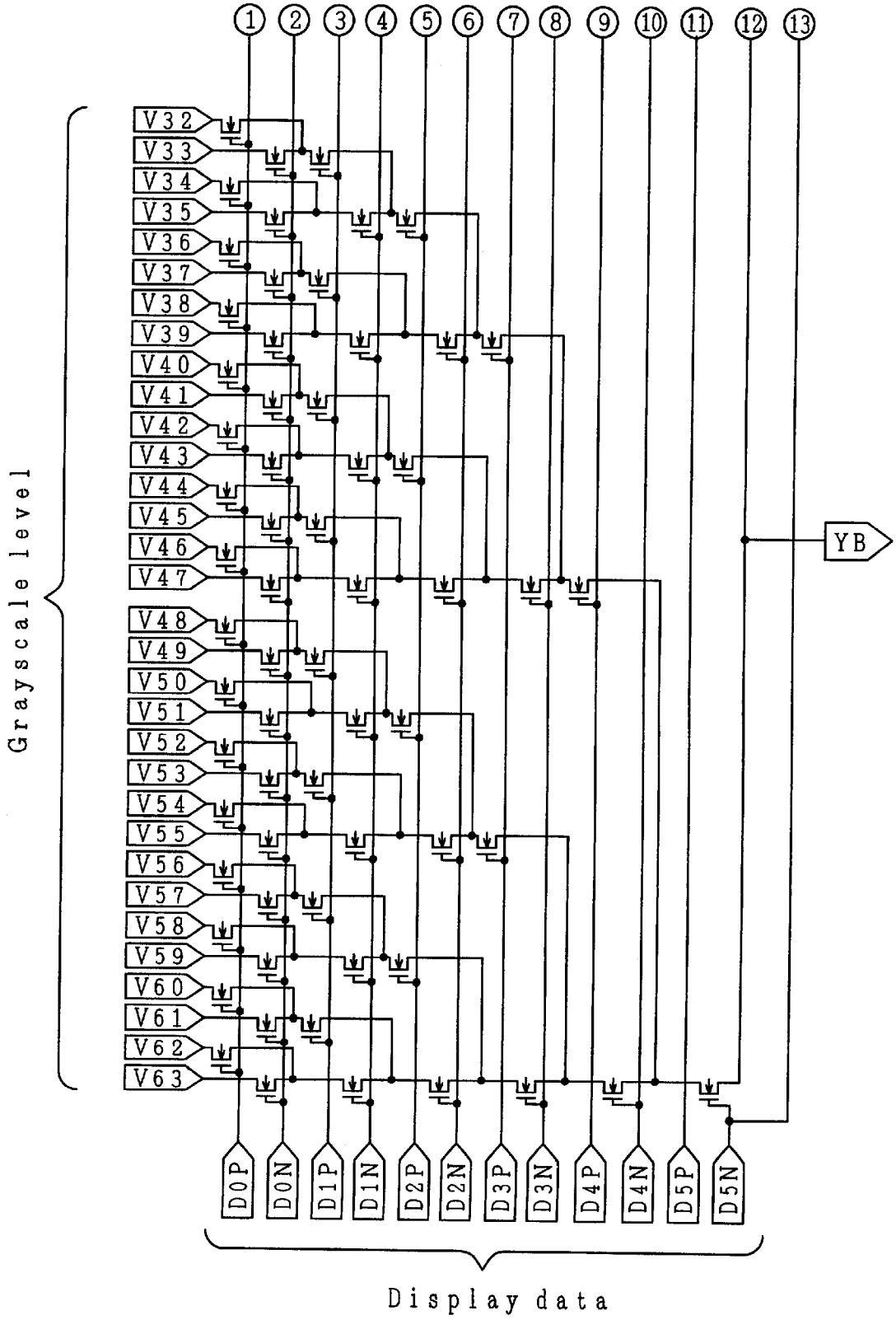
FIG. 13 is a partial circuit diagram illustrating one specific circuit along with FIG. 12 showing the low voltage decoder of the decoder circuit of the second embodiment of the present invention.
Figure 14:
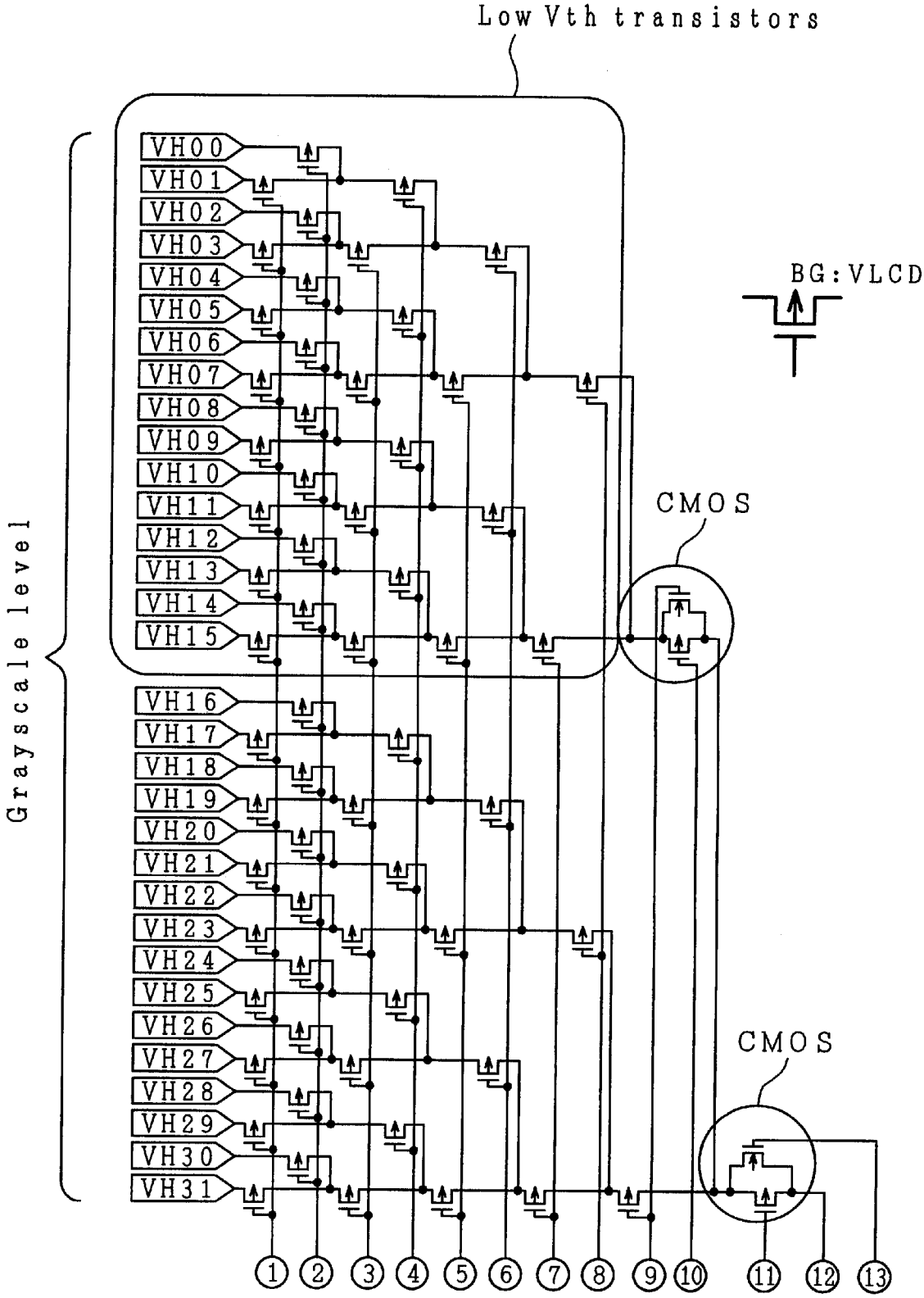
FIG. 14 is a specific circuit diagram of a high voltage decoder of the decoder circuit of the second embodiment of the present invention.
Figure 15:
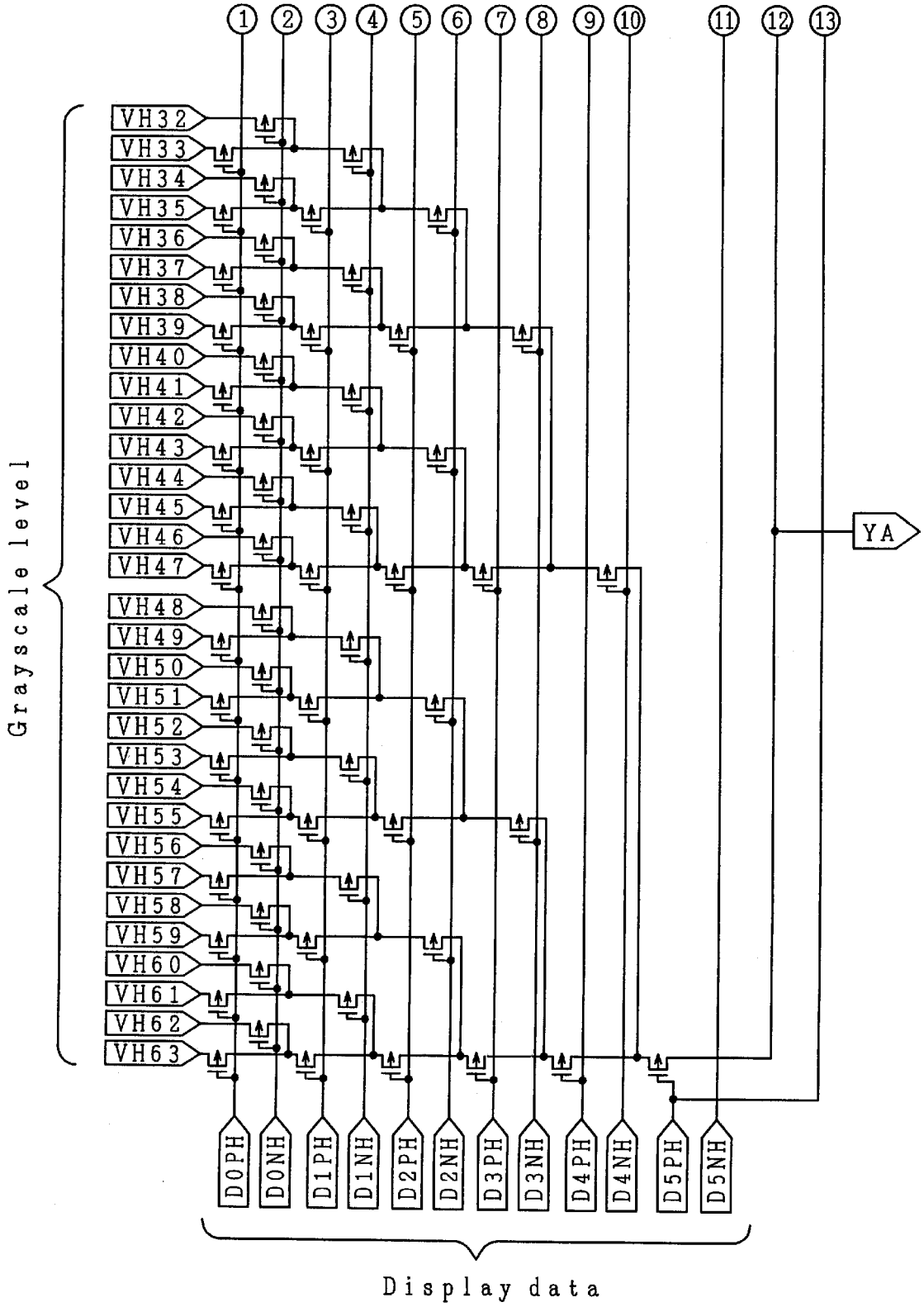
FIG. 15 is a partial circuit diagram illustrating one specific circuit along with FIG. 14 showing the high voltage decoder of the decoder circuit of the second embodiment of the present invention.

FIGS. 12 and 13 are specific circuit diagrams of a low voltage decoder of the decoder circuit of the present embodiment. FIGS. 14 and 15 are specific circuit diagrams of a high voltage decoder of the decoder circuit of thc present embodiment. In FIGS. 12 and 13 and FIGS. 14 and 15, circled numerals denote lines which are connected to one another.

Embodiment 3

Figure 16:
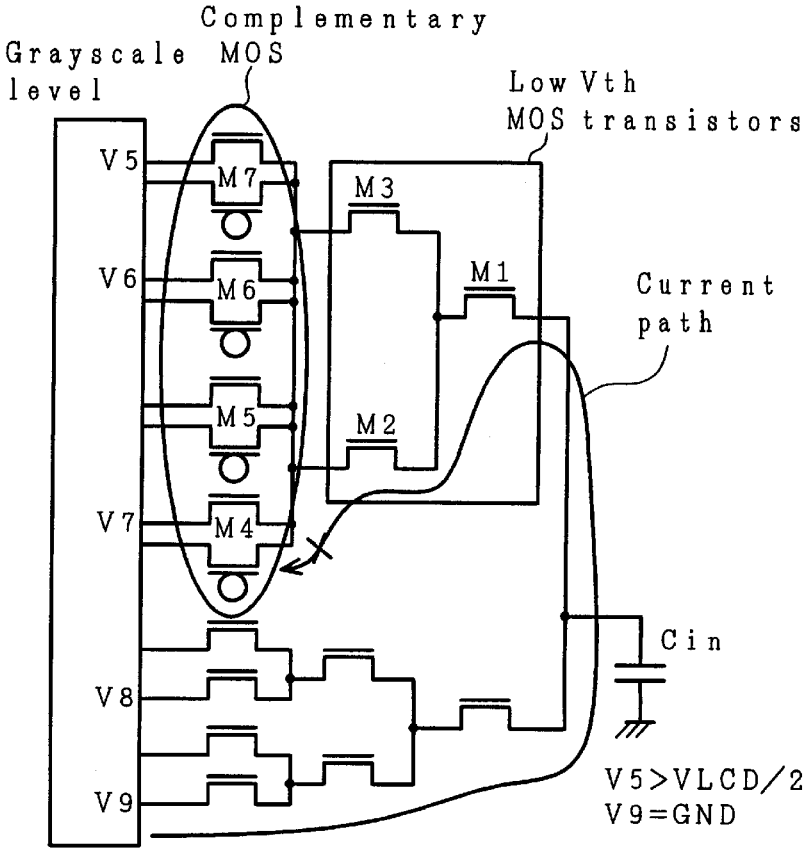
FIG. 16 is a schematic construction diagram illustrating a low voltage side decoder circuit of the decoder circuit of the second embodiment of the present invention.

FIG. 16 is a schematic construction diagram illustrating a low voltage decoder of a decoder circuit of the present embodiment. Similarly to each of the above-described embodiments, this decoder circuit is also a tournament type decoder circuit which gradually decrcases the number of grayscale levels to be selected, from its lower-order bit to its higher-order bit.

Incidentally, for ease of understanding of the invention, FIG. 16 to be referred to in the following description of the present embodiment shows the essential circuit of the embodiment in simple form. Actually, it goes without saying that in the case of, for example, a 64-gray-level display, MOS transistors are needed by a number which enables selection of 64 grayscale levels.

In the present embodiment, the MOS transistors M4 to M7 which correspond to the lowest-order display data bits of a low Vth grayscale group are formed of CMOS transistors, respectively. By forming the MOS transistors M4 to M7 as CMOS transistors, similarly to the above-described embodiments 1 and 2, the MOS transistors can be reliably turned on and off at all grayscale levels, whereby it is possible to prevent a current from flowing from an output side into the low Vth portion indicated by an arrow in FIG. 16, owing to a grayscale level applied to another portion.

Embodiment 4

Figure 17:
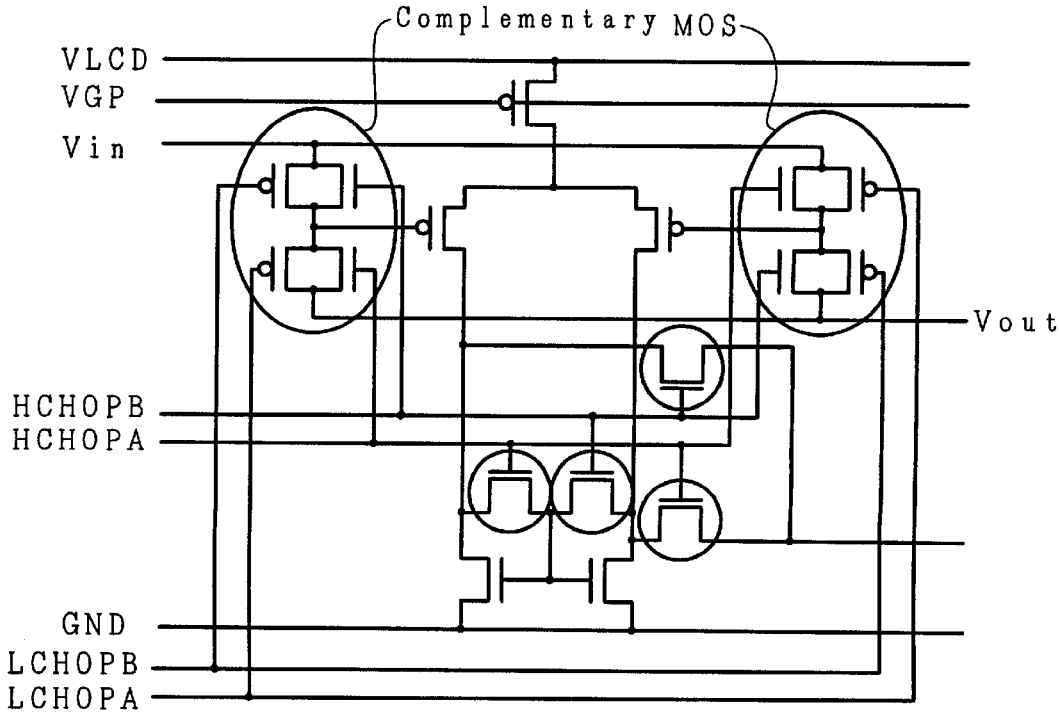
FIG. 17 is a circuit diagram illustrating an embodiment of a differential input portion of a low voltage side amplifier circuit which constitutes a drain driver according to the present invention.
Figure 37:
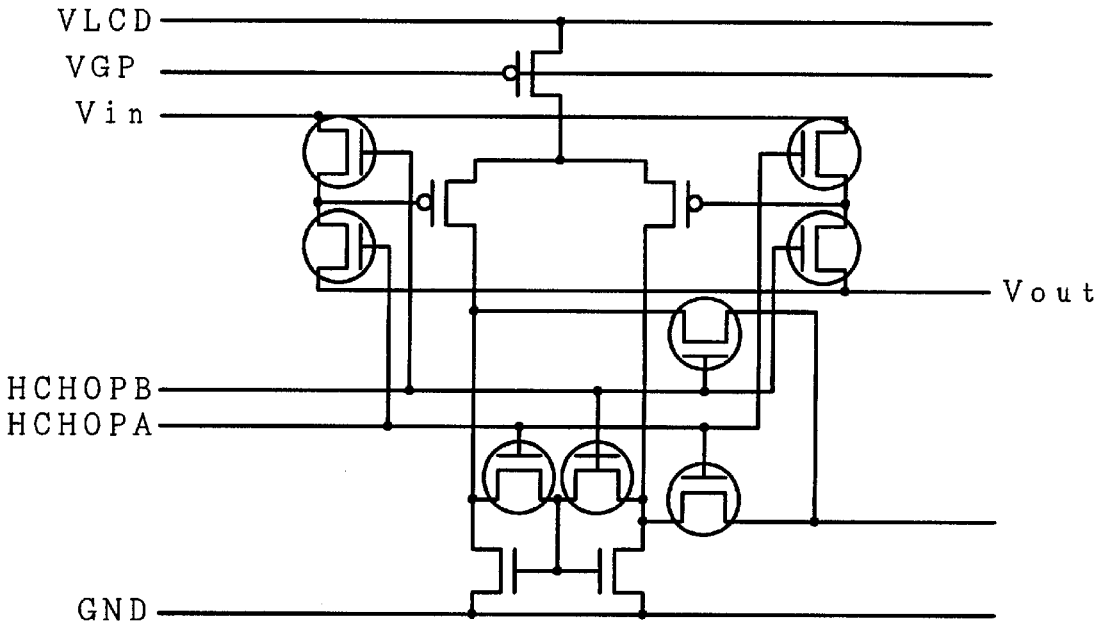
FIG. 37 is a circuit diagram illustrating a differential input portion which constitutes an amplifier circuit of a low-voltage-dedicated circuit of a related-art drain driver.

FIG. 17 is a circuit diagram illustrating an embodiment of a differential input portion of a low voltage amplifier circuit which constitutes the drain driver according to the present invention. In the present embodiment, part of the MOS transistors of the amplifying circuit (chopper circuit) described previously with reference to FIG. 37, for effecting switchover between the input and output parts of an amplifier circuit which constitutes the drain driver are formed as CMOS transistors so that the output voltage range can be enlarged.

In the present embodiment, MOS transistors which are located in the portions surrounded by elliptic circles in FIG. 17 are formed as CMOS transistors (marked with "complementary CMOS" in FIG. 17). MOS transistors which serve as switching elements in the other portions are formed of only NMOS transistors because the, output voltage range is within a voltage range which can be sufficiently outputted from only NMOS transistors.

Figure 18:
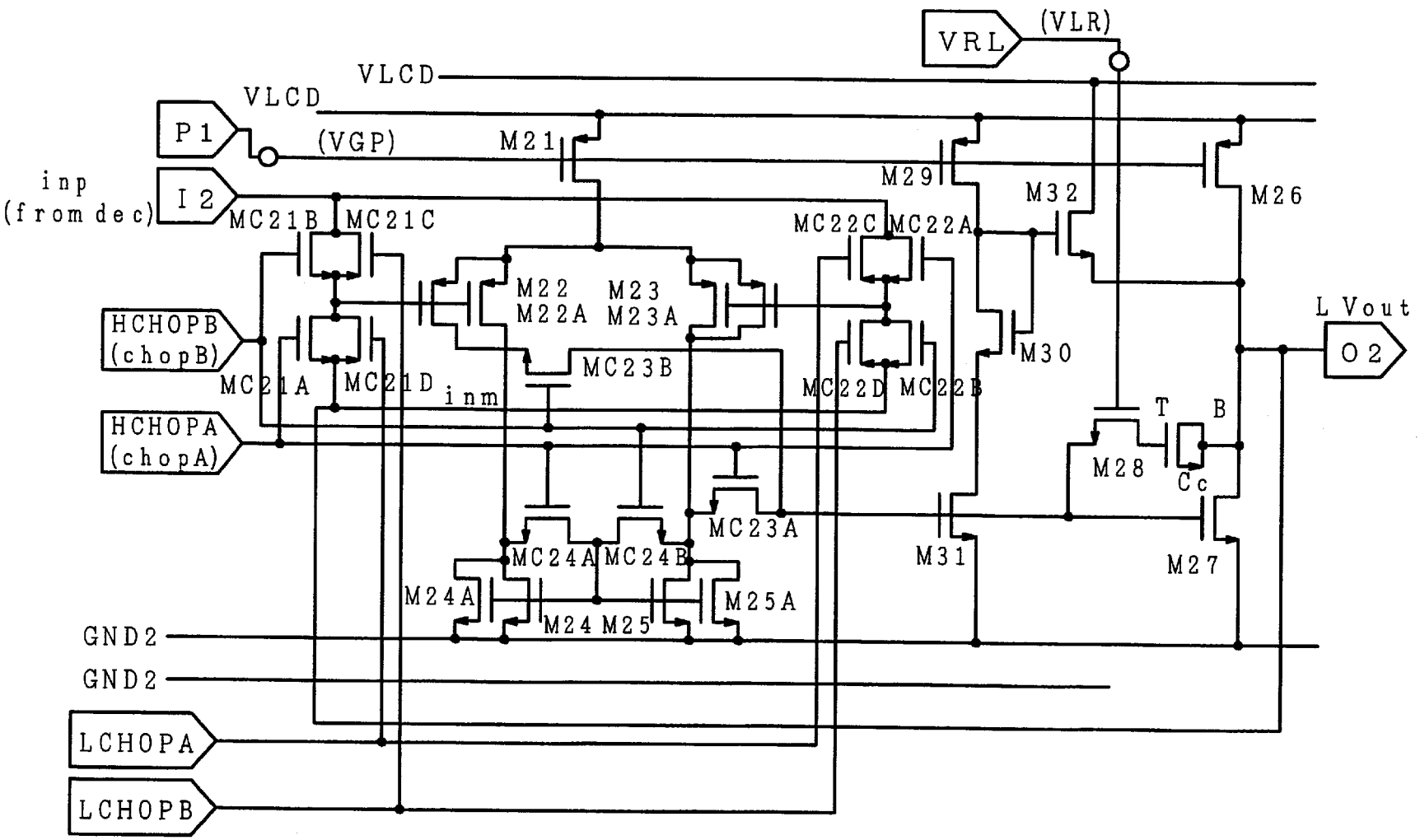
FIG. 18 is a circuit diagram illustrating a specific constructional example of the low voltage side amplifier circuit of the second embodiment of the present invention.
Figure 19:
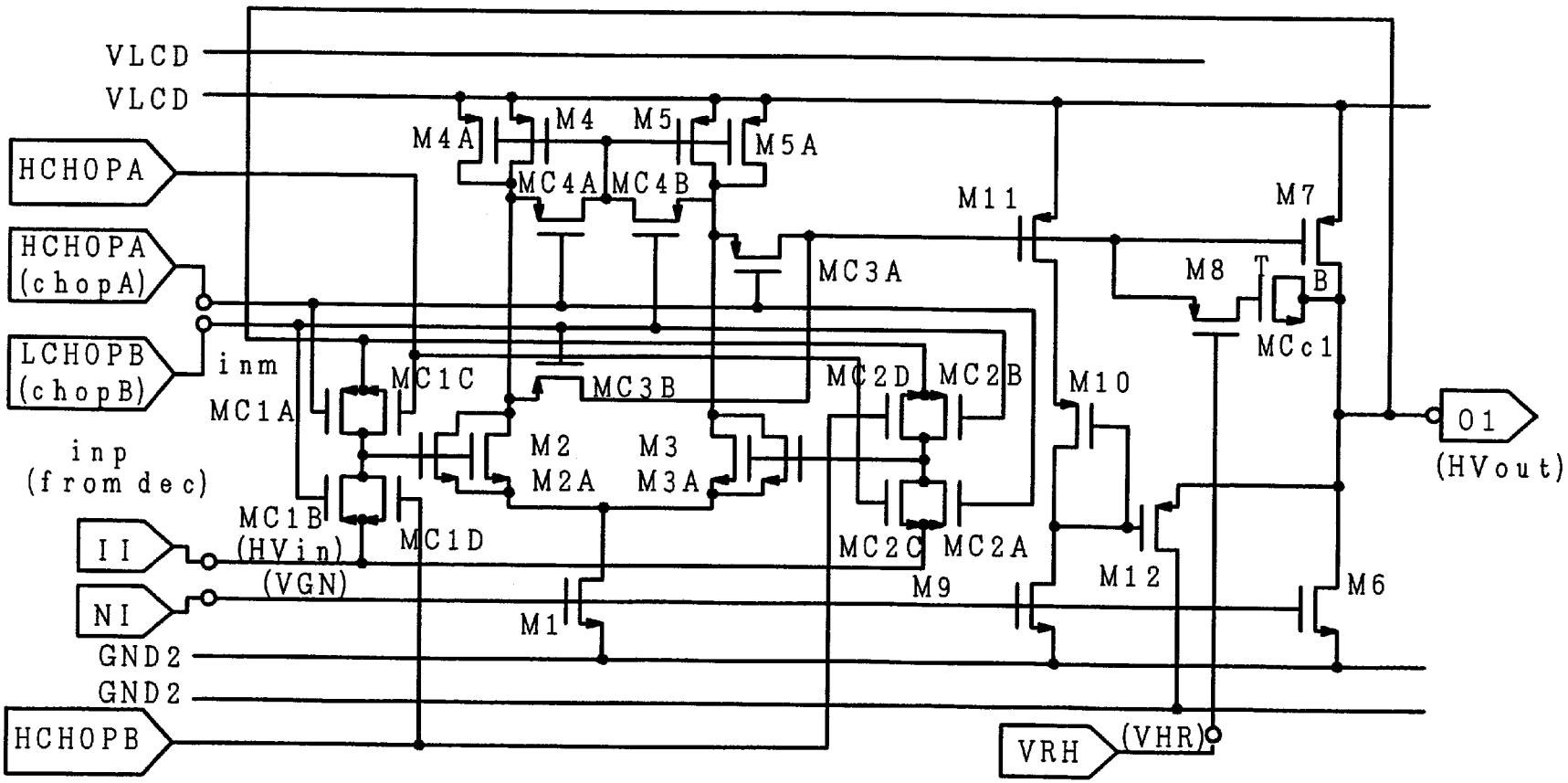
FIG. 19 is a circuit diagram illustrating another specific constructional example of the low voltage side amplifier circuit of the second embodiment of the present invention.

FIG. 18 is a circuit diagram illustrating a specific example of the construction of a low voltage amplifier circuit of the present embodiment, and FIG. 19 is a specific circuit diagram illustrating a specific example of the construction of a high voltage amplifier circuit of the present embodiment. By combining these circuits with any of the above-described embodiments 1 to 3, it is possible to enlarge the output voltage range, inclusive of the output of the amplifier circuit.

Embodiment 5

Figure 20:
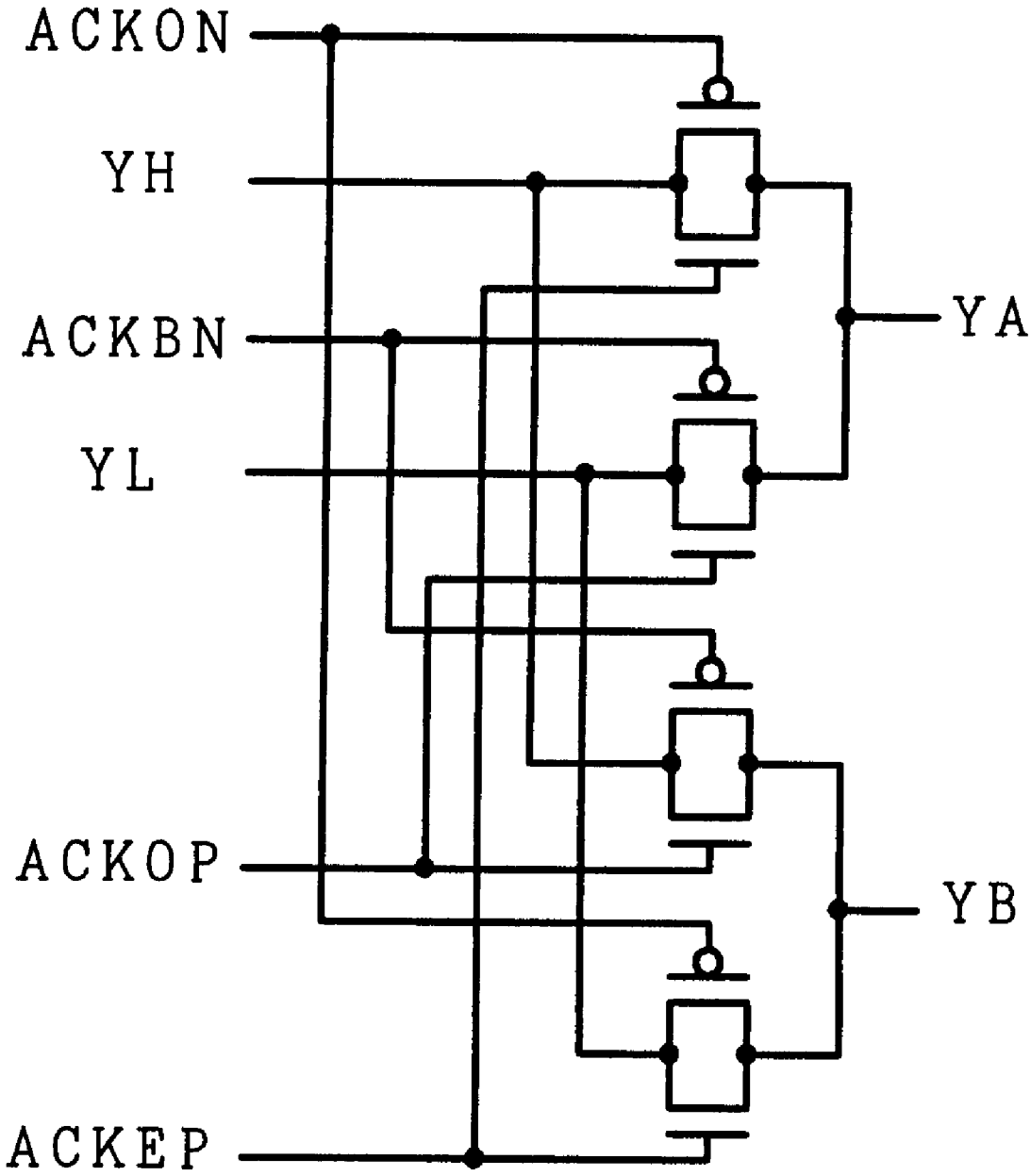
FIG. 20 is a circuit diagram illustrating an embodiment of an output selection circuit (output selector circuit) which constitutes the drain driver according to the present invention.
Figure 38:
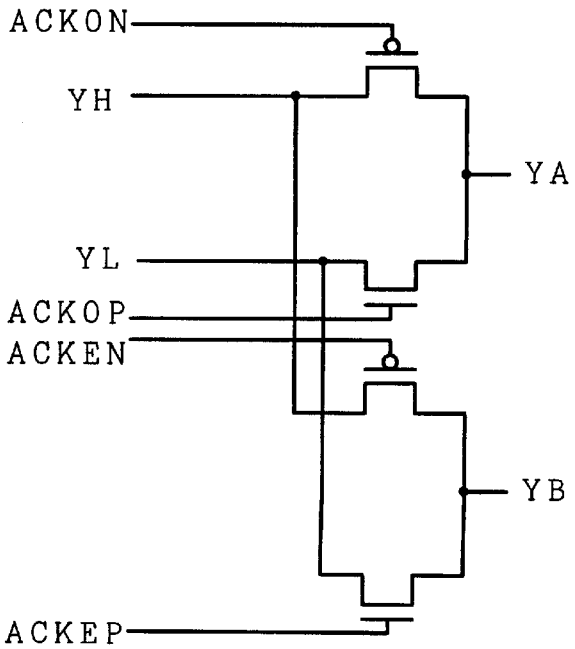
FIG. 38 is a circuit diagram of an output selection circuit for selecting either one of the amplifier circuit output of thc low-voltage-dedicated circuit and the amplifier circuit output of the high-voltage dedicated circuit.
Figure 39:
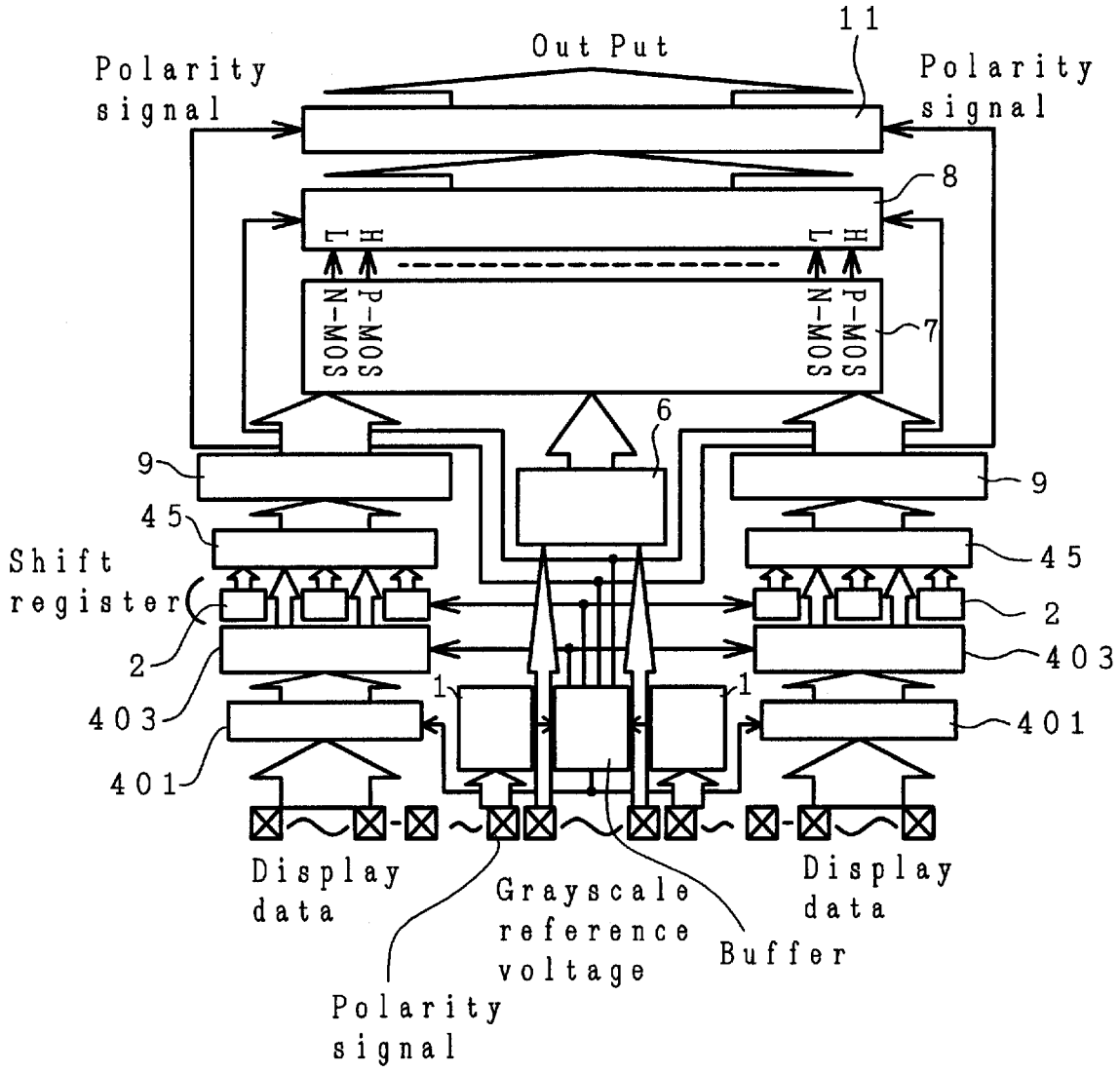
FIG. 39 is a block diagram illustrating the construction of a drain driver.

FIG. 20 is a circuit diagram illustrating an embodiment of an output selection circuit (an output selector circuit) which constitutes the drain driver according to the present invention. In the present embodiment, the MOS transistors of the output selector circuit described previously with reference to FIG. 38 are formed as CMOS transistors so that the output voltage range can be enlarged.

In the present embodiment, by combining this circuit with any of the above-described embodiments 1 to 4, it is possible to enlarge the output voltage range of the drain driver, whereby it is possible to realize a drain driver of a dot inversion driving type which enables asymmetric driving of negative and positive voltage sides which is capable of sufficiently coping with a decrease in the power consumption of the liquid crystal display device due to a lowering of VLCD and the penetration of a voltage into a pixel MOS transistor portion.

Embodiment 6

Figure 21:
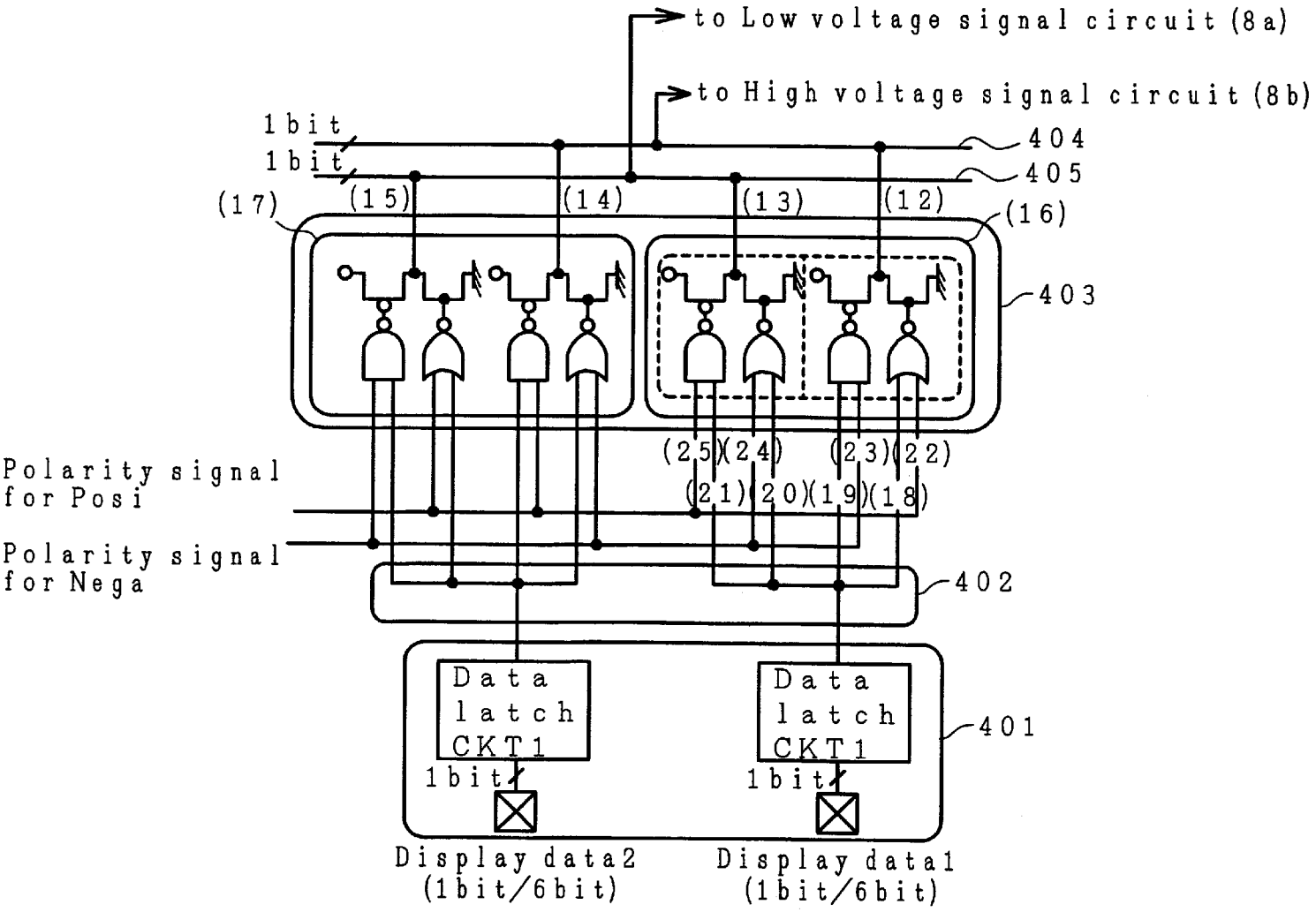
FIG. 21 is a circuit diagram illustrating a display data input switchover circuit which constitutes the drain driver according to the present invention.
Figure 40:
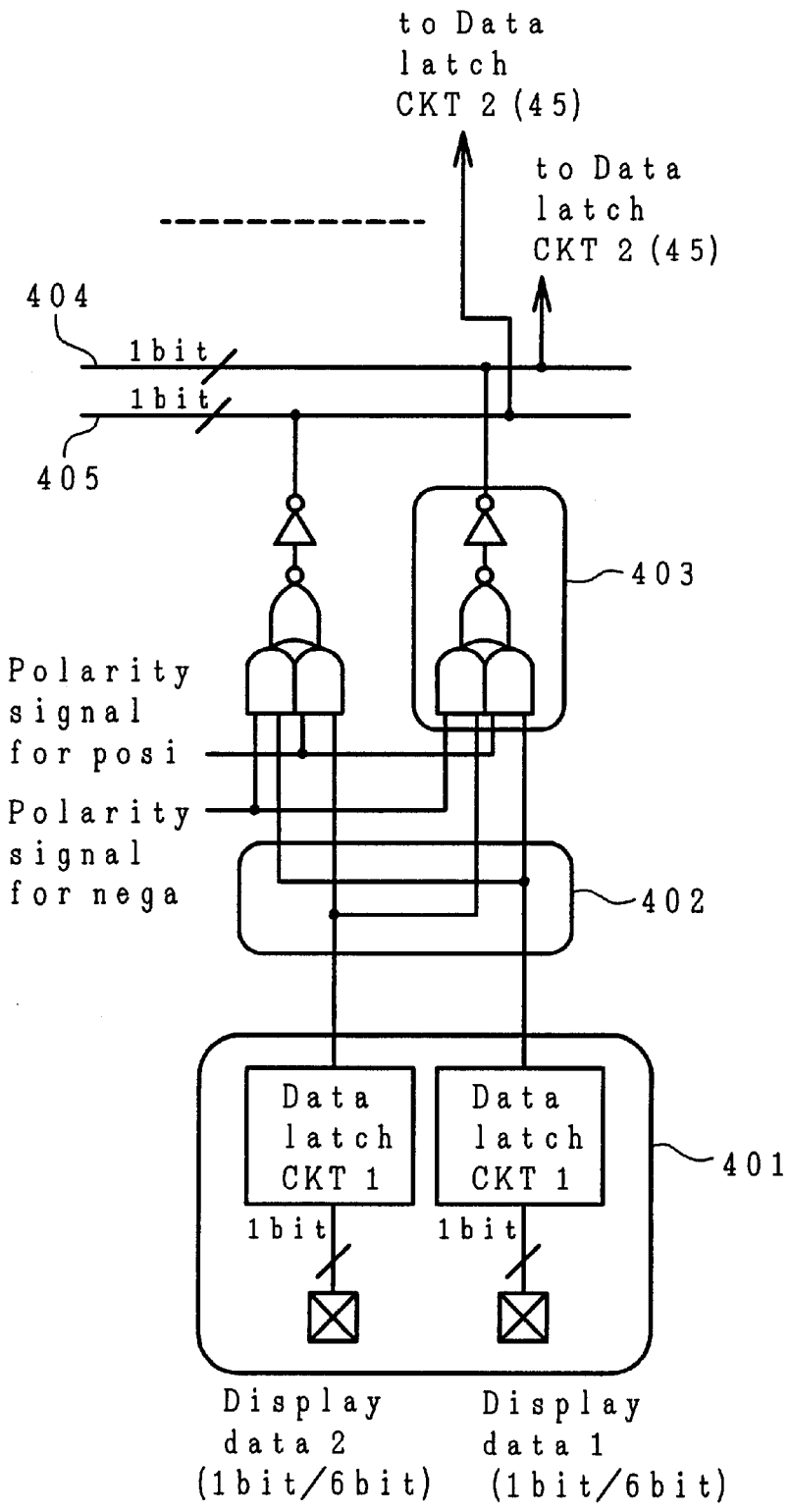
FIG. 40 is a circuit diagram of a related-art display data switchover circuit.

FIG. 21 is a circuit diagram illustrating a display data input switchover circuit which constitutes the drain driver according to the present invention. This circuit corresponds to the display data multiplexer 10 described previously with reference to FIG. 2 (the related-art example thereof has been described with reference to FIG. 40), and reference numeral 401 denotes a display data input part, reference numeral 402 switchover lines, reference numeral 403 switchover circuits, and reference numerals 404 and 405 data lines.

In the drain driver of a liquid crystal display device provided with a dot inversion driving type of TFI display panel, this display data switchover circuit (multiplexer) is provided with the switchover circuits 403 which receive through the switchover lines 402 display data inputted to the display data input part having first and second data latch circuits, and outputs positive and negative display data to the data lines 404 and 405.

The present embodiment uses the two switchover circuits 403 which are capable of generating the positive, negative and off output states of two different display data (display data 1 and display data 2), respectively, and the outputs of the respective circuits are switched therebetween by being connected to either one of the data lines 404 or 405.

Specifically, in the switchover circuits 403, tristate-type buffers (16) and (17) are used as switchover circuits for 2 pixels×1 bit, respectively. In this case, only an input of 1 pixel×1 bit of a display data input is inputted to inputs (18), (19), (20) and (21) of the buffer (16) of the switchover circuit 403, and the positive signal of a polarity inverting signal is inputted to inputs (22) and (25), while the negative signal of the polarity inverting signal is inputted to inputs (23) and (24). Such a circuit is arranged in the form of 6 pixels ×6 bits.

At an output (12) or (13) of the buffer (16) two output-on states and an output-off state, a total of three output states can be generated by the polarity inverting signals. The positive signal of the polarity inverting signal (polarity inverting positive signal) and the negative signal of the polarity inverting (polarity inverting negative signal) are inversely inputted to the respective inputs of the output (12) or (13) of the buffer (16), whereby according to the state of the polarity inverting signal, either one of the outputs (12) or (13) is turned on while the other is turned off. In addition, a similar state is generated at an output (14) or (17) of the buffer (17).

In the relationships between the outputs (12) and (13) of the buffer (16) and between the outputs (14) and (15) of the buffer (17), in case that the output (12) of the buffer (19) is connected to the data line 404 as shown in FIG. 21, the output (14) of the buffer (17) which is paired with the output (12) by an output-polarity-inverting switching operation is connected to the data line 404. In addition, the output (13) of the buffer (16) and the output (15) of the buffer (17) are connected to the data line 405.

According to this construction, either one is turned on and the other is turned off by polarity inverting signals, whereby a desired display signal input of 1 pixel×1 bit can be selected at each of the data lines 404 and 405. By disposing this construction in the form of 6 pixels×6 bits, it is possible to obtain a function similar to that of the related art.

Figure 22:
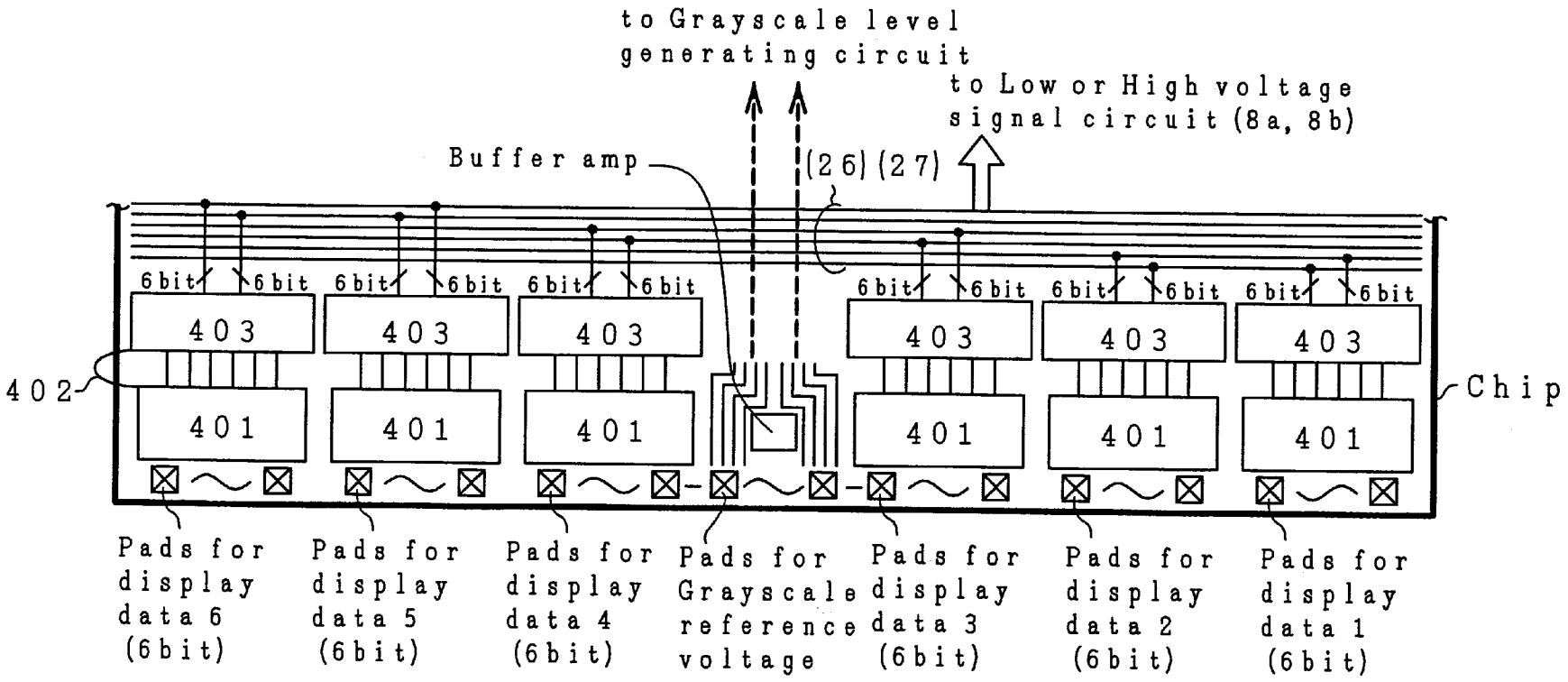
FIG. 22 is an explanatory view of a chip on which the display data input switchover circuit shown in FIG. 21 is mounted.
Figure 41:
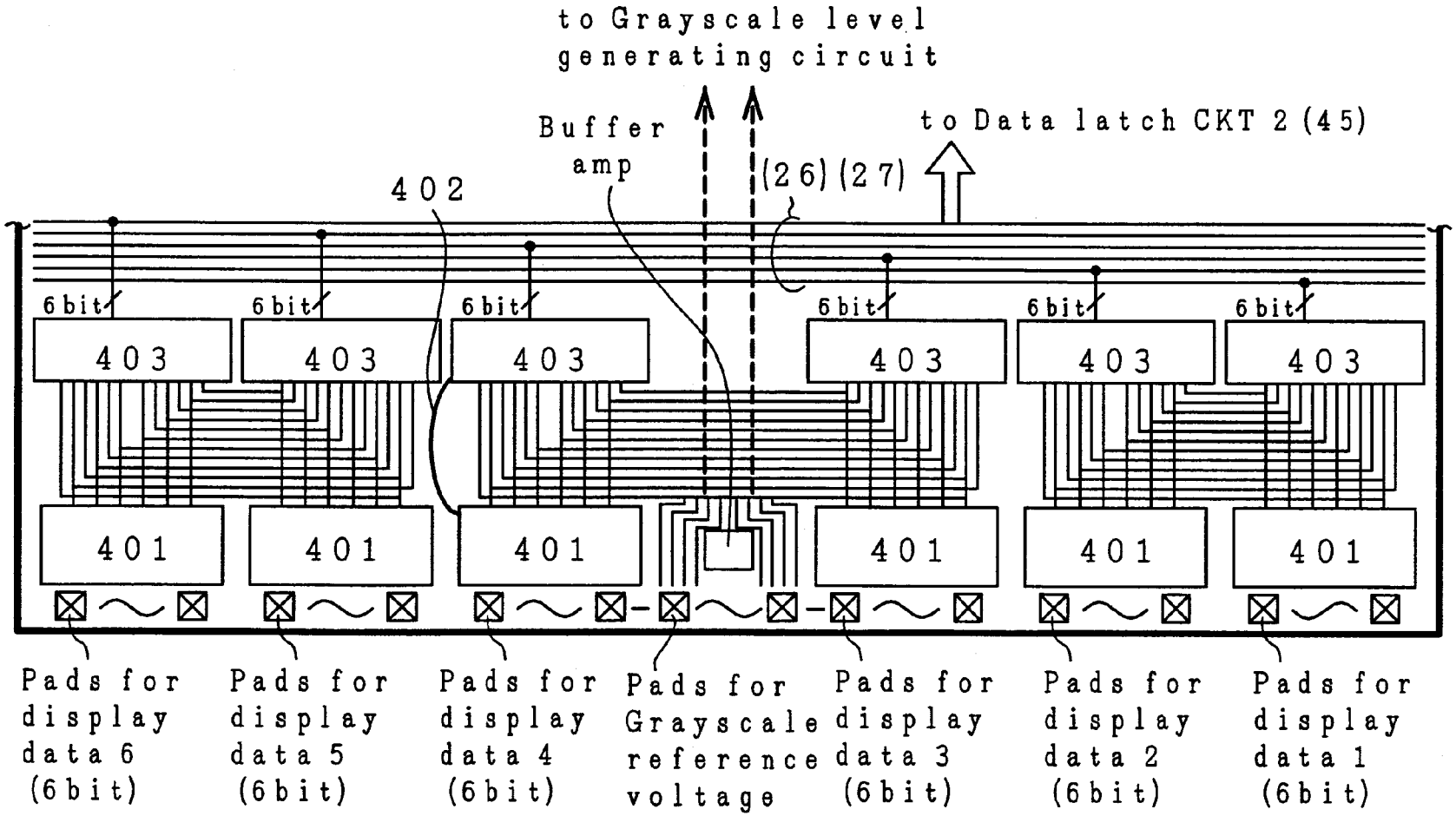
FIG. 41 is a wiring diagram of the chip of the drain driver.

FIG. 22 is an explanatory view of a chip on which display data input switchover circuits of the type shown in FIG. 21 are mounted. As shown in FIG. 22, ten additional transistors are needed compared to the related-art chip shown in FIG. 40, but this increased number can be sufficiently absorbed by a reduction in a line area of 2 pixels×6 bits×(line width+line pitch) which has been required in a display data switchover circuit of the related-art chip shown in FIG. 41. The number of data lines 404 and 405 for 6 pixels×6 bits are the same as in the related art, whereby it is possible to reduce the chip area without being limited by the arrangements of display data input terminals, control signal input terminals and reference voltage input terminals.

Embodiment 7

Figure 23:
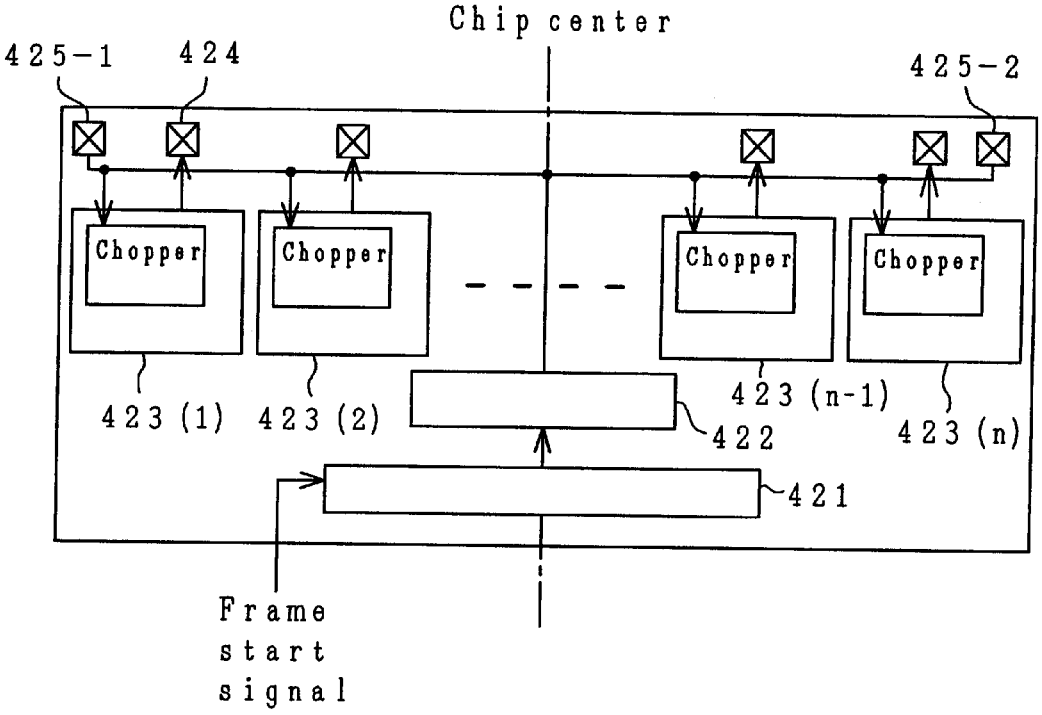
FIG. 23 is a schematic view illustrating the arrangement of a test terminal on a chip which constitutes the drain driver according to the present invention.
Figure 42:
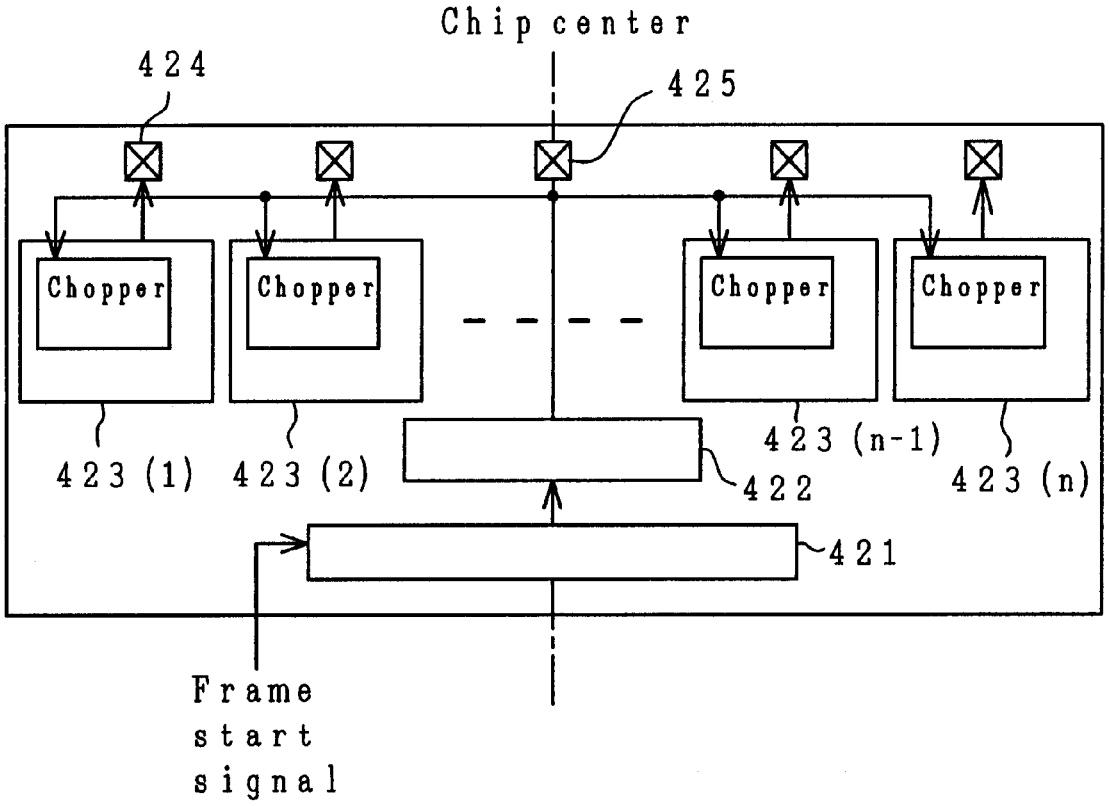
FIG. 42 is a block diagram illustrating the arrangement of a test terminal on a related-art drain driver.

FIG. 23 is a block diagram illustrating, an arrangement of a test terminal on a chip which constitutes the drain driver according to the present invention. In FIG. 23, reference numerals identical to those used in FIG. 42 denote functional portions identical to those shown in FIG. 42.

In FIG. 23, a chopper control signal is generated from a frame start signal inputted from outside, by a chopper control signal generation circuit 421, and is supplied to each amplifier circuit 423 through a level shifter circuit 422.

At this time, in terms of the characteristics of signal propagation, it is advantageous that the output of the chopper control signal generation circuit 421 is connected to a chopper control signal line at the chip center portion. In this arrangement, a first test terminal 425-1 and a second test terminal 425-2 which are connected to the chopper control line are arranged at chip ends which correspond to the opposite ends of the chopper control line.

By making an inspection with these first test terminal 425-1 and second test terminal 425-2, it is possible to easily determine whether the chopper control signal is supplied to all amplifier circuits 423(1) to 423(n) within the chip.

In addition, to drive the load of test equipment, a buffer circuit may also be arranged between the chopper control signal and the test terminals.

Embodiment 8

Figure 24:
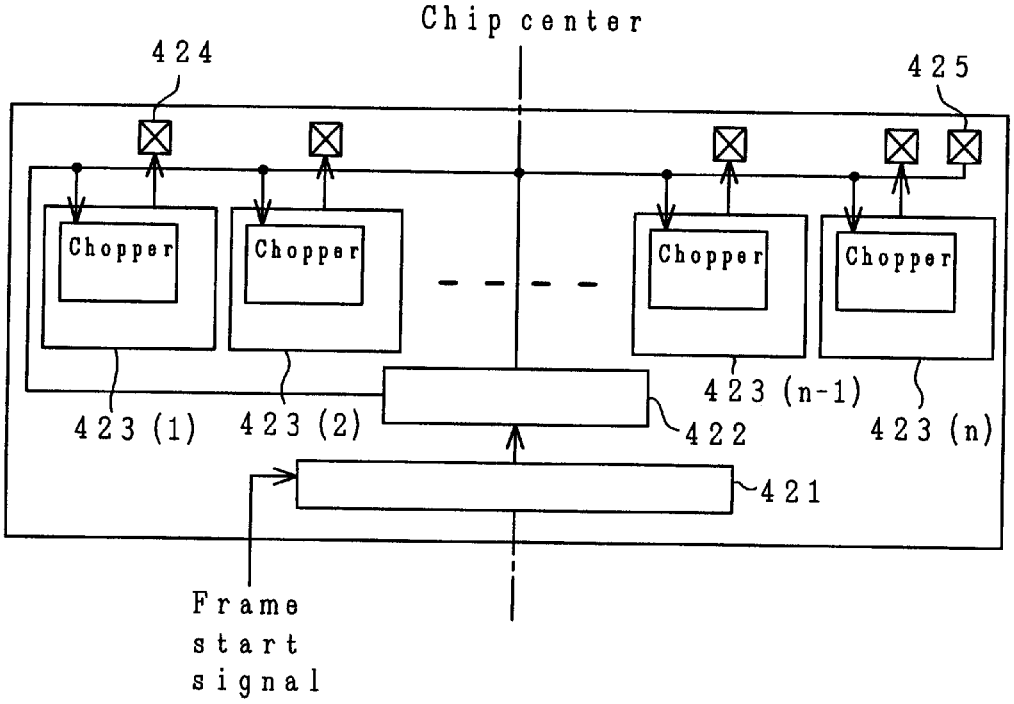
FIG. 24 is a schematic view illustrating another arrangement of the test terminal on the chip which constitutes the drain driver according to the present invention.

FIG. 24 is a block diagram illustrating another arrangement of a test terminal on a chip which constitutes the drain driver according to the present invention. In FIG. 24, reference numerals identical to those used in FIG. 2 denote functional portions identical to those shown in FIG. 42.

In the present embodiment, for example, in case that the weakening of signals does not become a problem, the output of a chopper control signal generation circuit 421 is connected to one end of a chopper control signal line at an edge portion of the chip, while a test terminal 425 is arranged at the other end of the chopper control signal line.

In this construction as well, by making an inspection with the test terminal 425, it is possible to readily determine whether a chopper control signal has been supplied to all amplifier circuits 423(1) to 423(n).

Similarly to Embodiment 7, to drive a load of test equipment, a buffer circuit may also be arranged between the chopper control signal and the test terminal.

Embodiment 9

Figure 25:
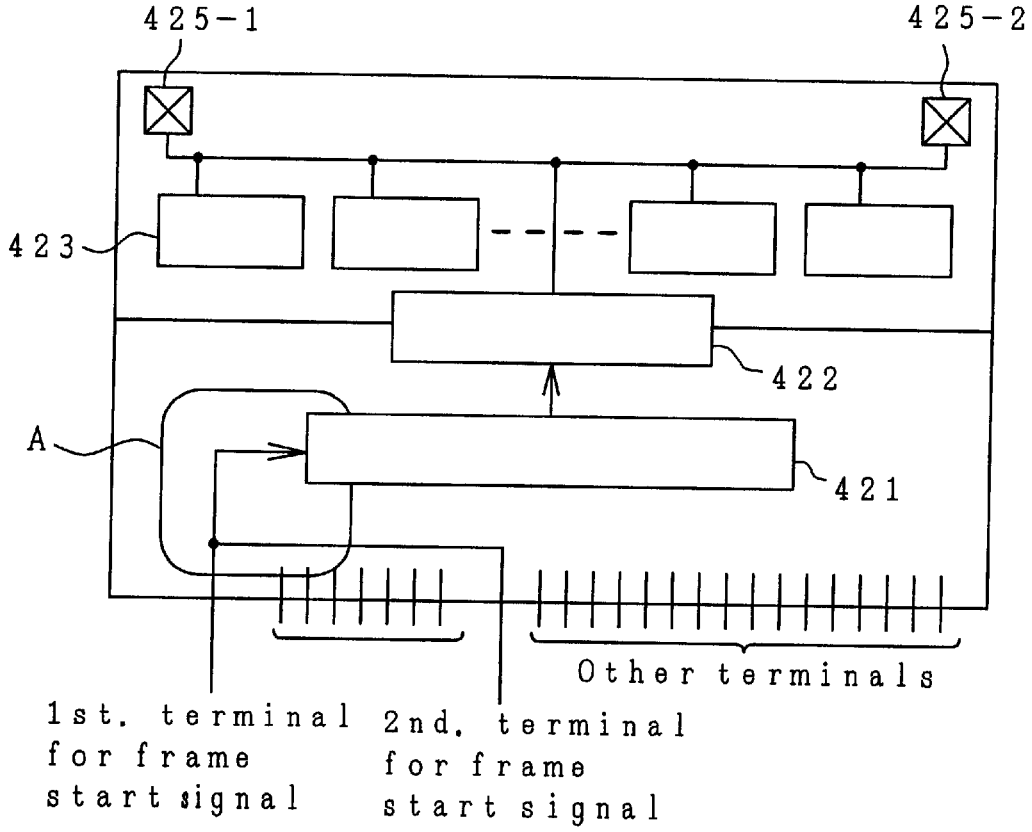
FIG. 25 is a schematic view illustrating the arrangement of a frame start signal terminal on thc chip which constitutes the drain driver according to the present invention.

FIG. 25 is a block diagram illustrating another arrangement of a test terminal on a chip which constitutes the drain driver according to the present invention. In FIG. 25, reference numerals identical to those used in FIG. 23 denote functional portions identical to those shown in FIG. 23. FIG. 25 shows in simple form the constructions of the amplifier circuits and others shown in FIG. 24.

In the present embodiment, frame start signal input terminals are arranged at a plurality of positions on the chip. In FIG. 25, other input terminals are shown to be arranged between first and second frame start signal input terminals.

According to this construction, it is possible to change the arrangement of terminals (pins) on a package such as a TCP without redesigning the chip. A plurality of frame start signals 1 and 2 can be synthesized by a circuit such as that shown in FIG. 26.

Figure 26:
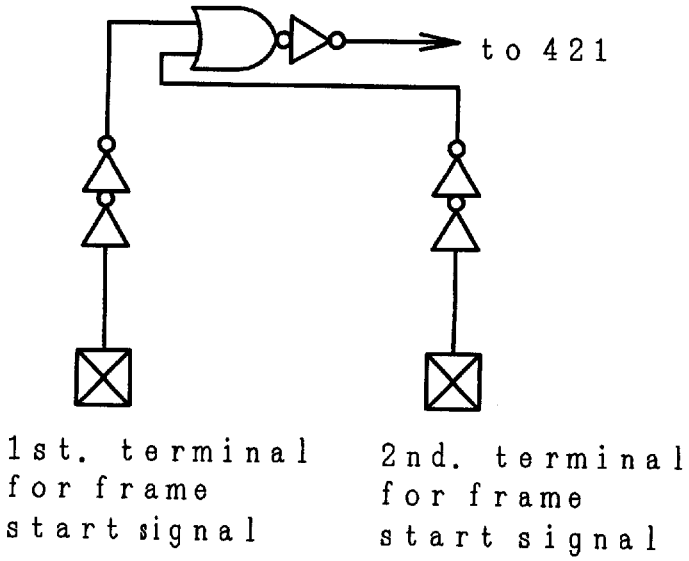
FIG. 26 is a circuit diagram illustrating a constructional example of a portion A of FIG. 25.

FIG. 26 is a circuit diagram illustrating an example of the construction of a portion A of FIG. 25. The frame start signal 1 and the frame start signal 2 are synthesized by this circuit, and can be used at any of the input terminals. Incidentally, only input terminals located at the positions required for designing a printed circuit board for a liquid crystal panel may be disposed outside a package.

According to the present embodiment, is possible to prevent an increase in the development cost of chips and an increase in the number of kinds of articles to be produced, and therefore, it is possible to reduce the manufacturing cost of liquid crystal panels.

Embodiment 10

Figure 27:
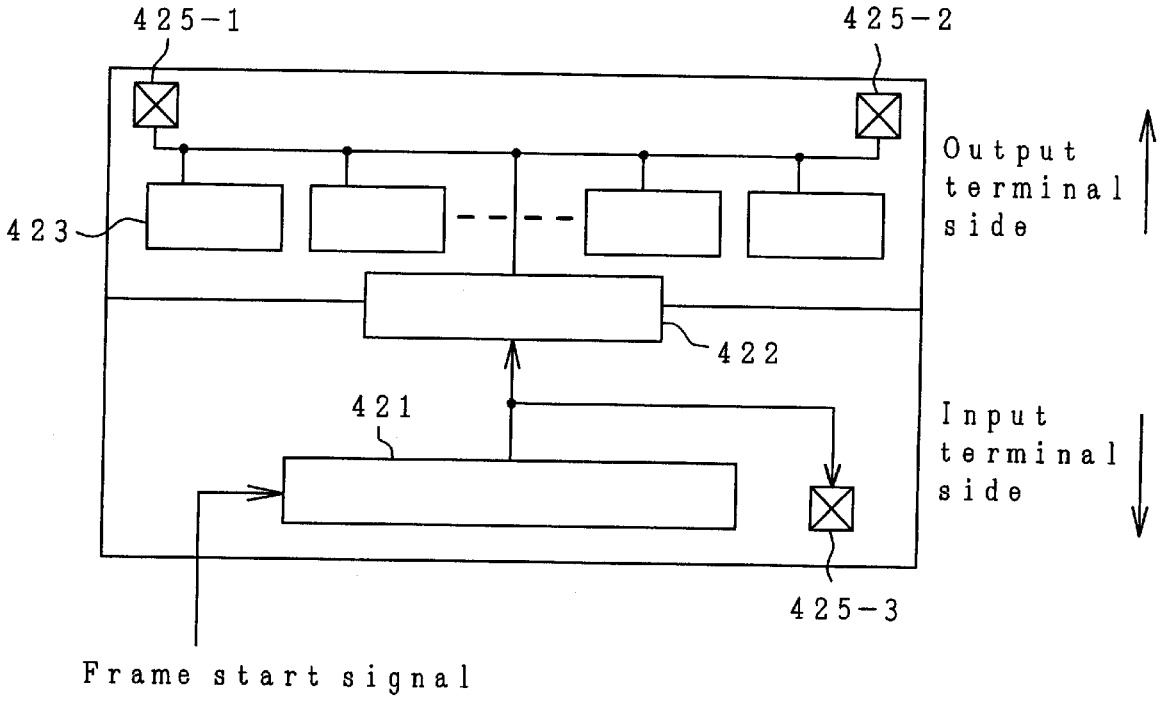
FIG. 27 is a schematic view illustrating yet another arrangement of the test terminal on the chip which constitutes the drain driver according to the present invention.
Figure 28:
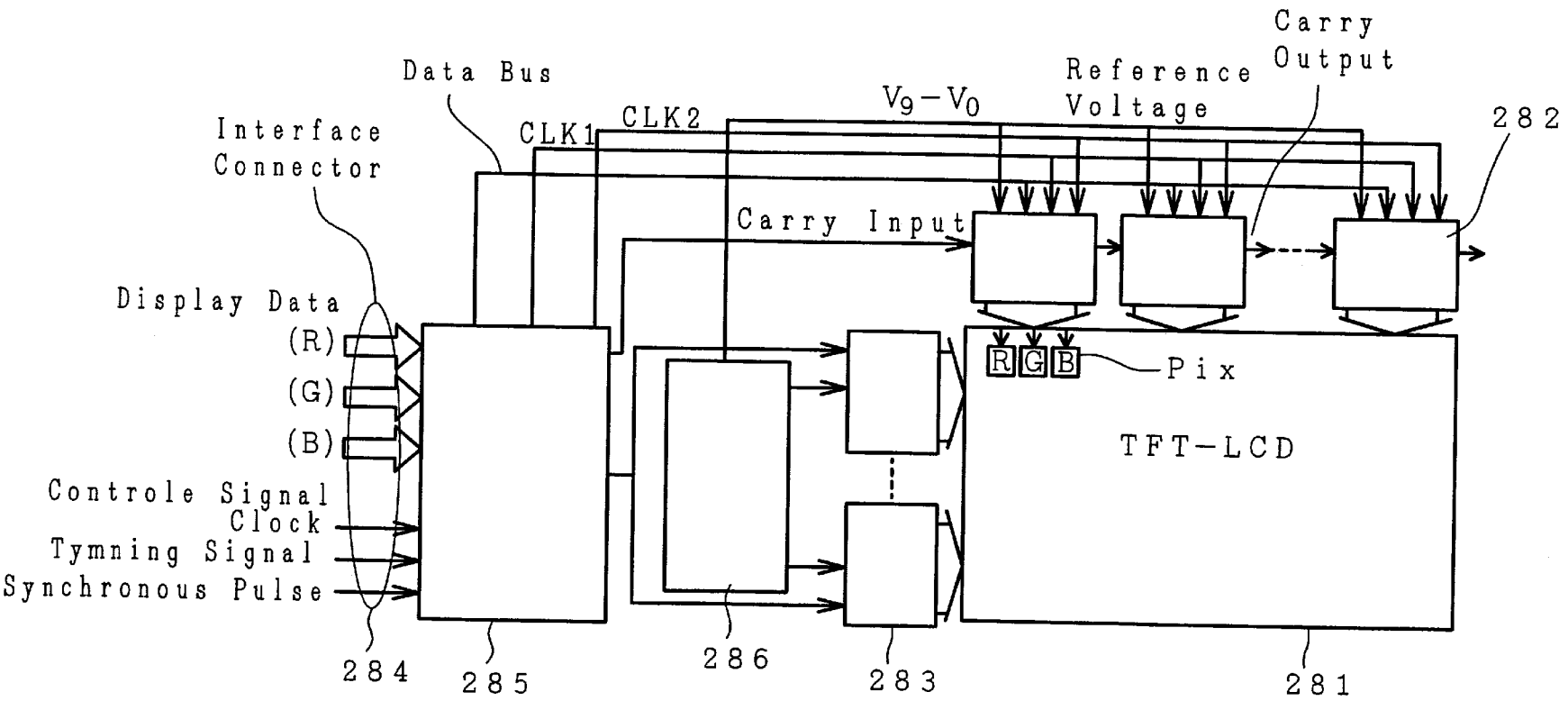
FIG. 28 is a block diagram schematically illustrating the construction of a liquid crystal display device to which the present invention is applied.
Figure 29:
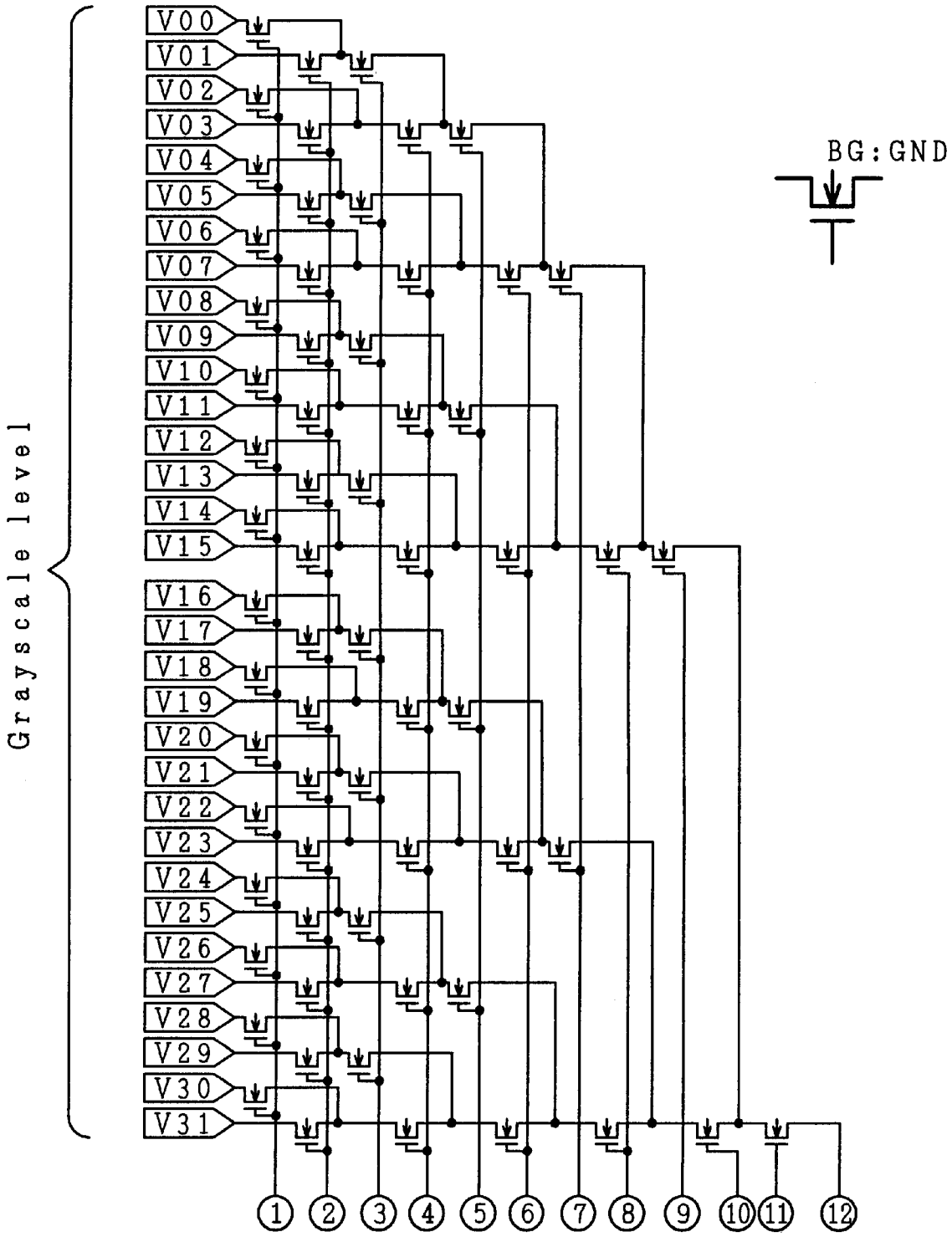
FIG. 29 is a partial circuit diagram illustrating one specific constructional example of a low-voltage-dedicated circuit of the drain driver.
Figure 30:
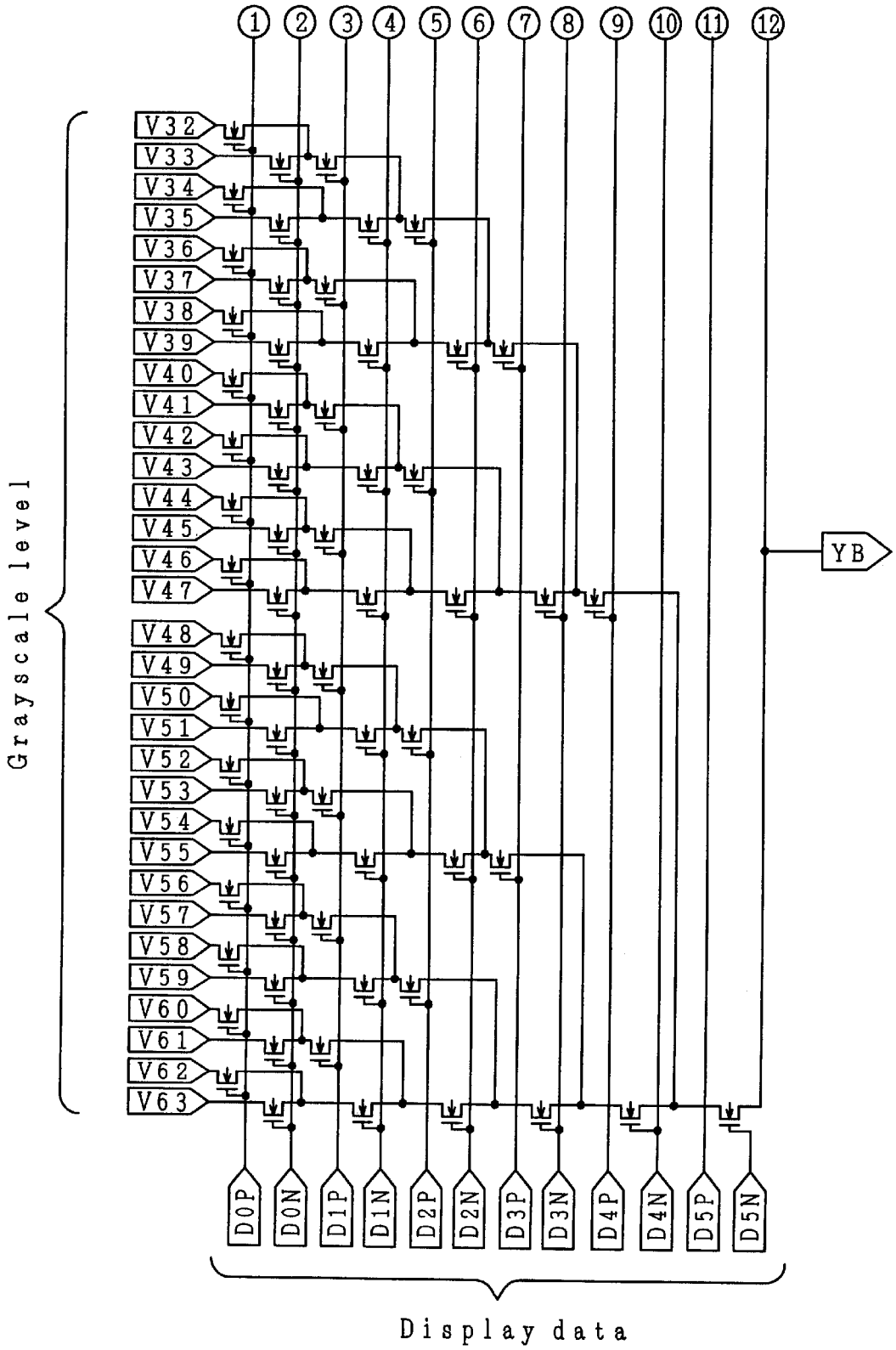
FIG. 30 is a partial circuit diagram constituting one circuit along with FIG. 29 illustrating one specific constructional example of a low-voltage-dedicated circuit of the drain driver.
Figure 31:
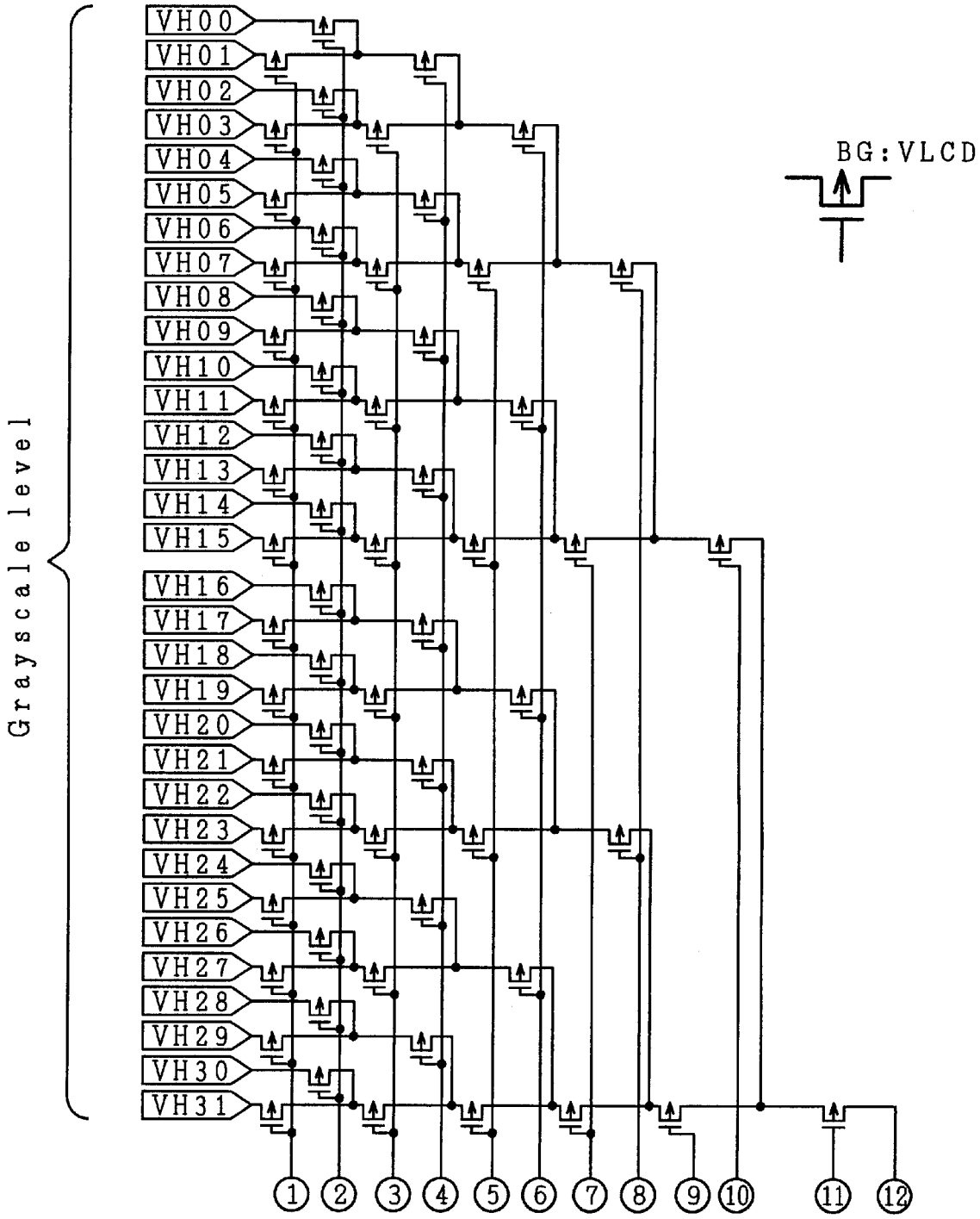
FIG. 31 is a partial circuit diagram illustrating one specific constructional example of a high-voltage-dedicated circuit of the drain driver.
Figure 32:
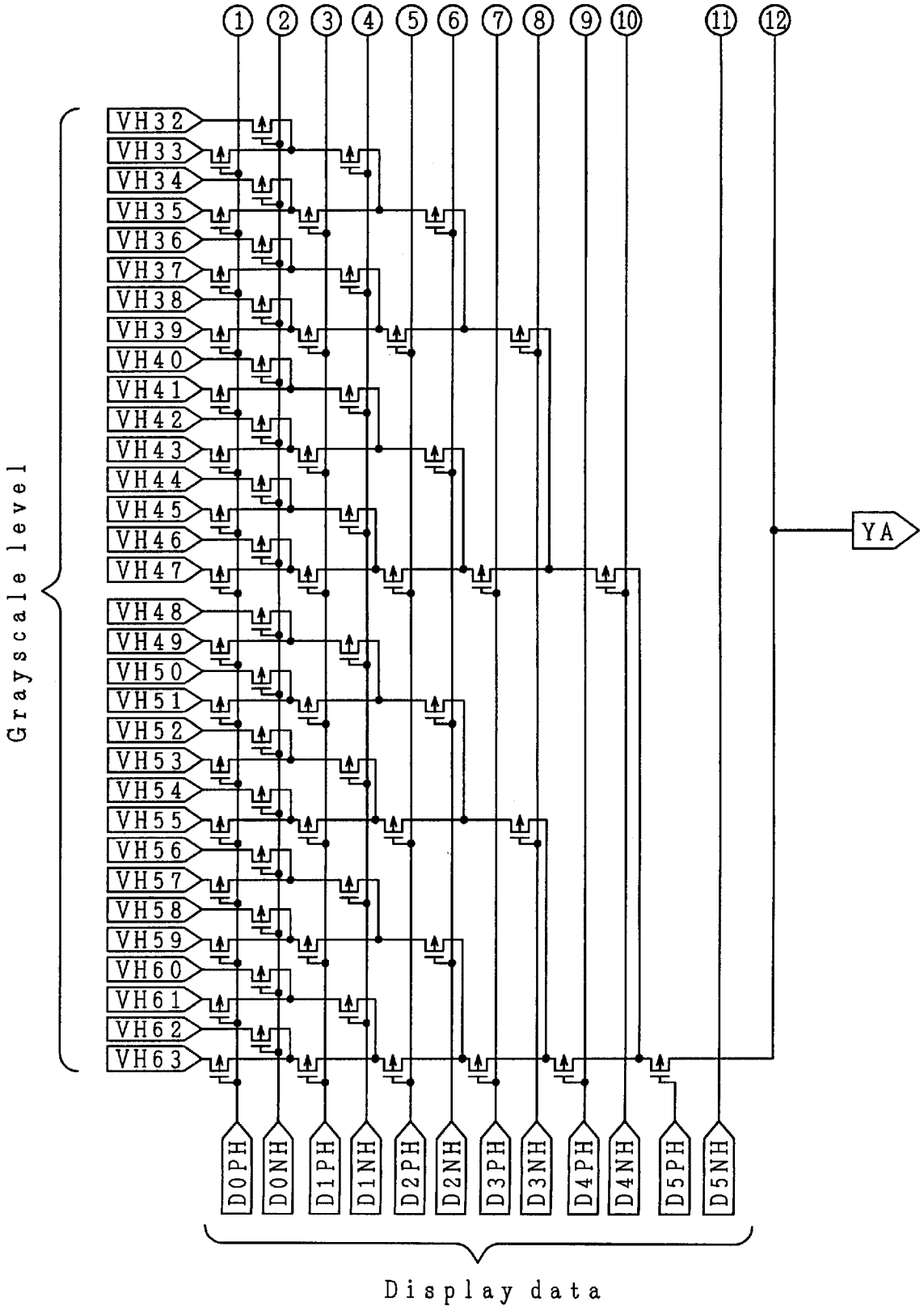
FIG. 32 is a partial circuit diagram illustrating one circuit along with FIG. 31 illustrating one specific constructional example of a high-voltage-dedicated circuit of the drain driver.
Figure 33:
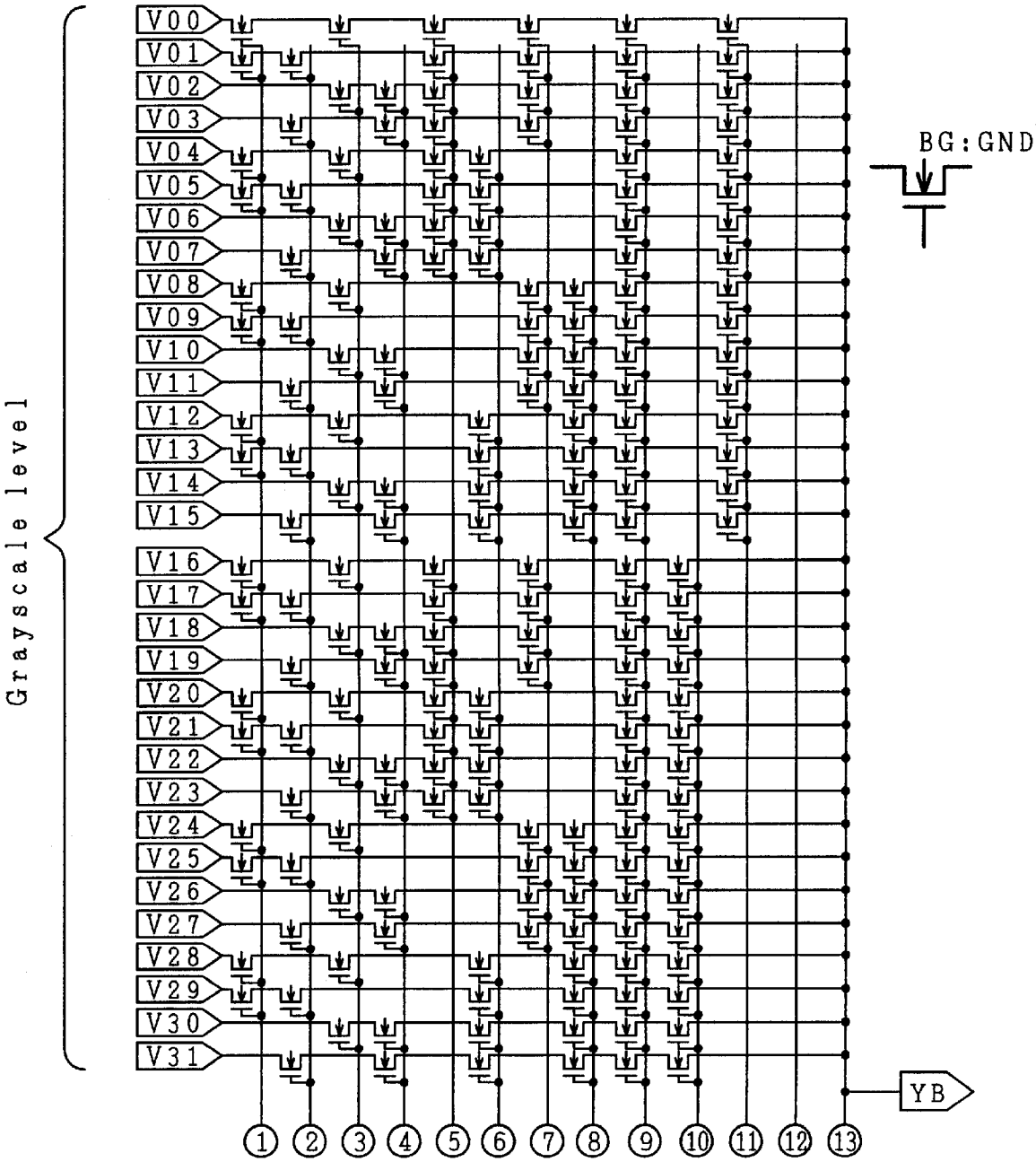
FIG. 33 is a partial circuit diagram illustrating another specific constructional example of the low-voltage-dedicated circuit of ithe drain driver.
Figure 34:
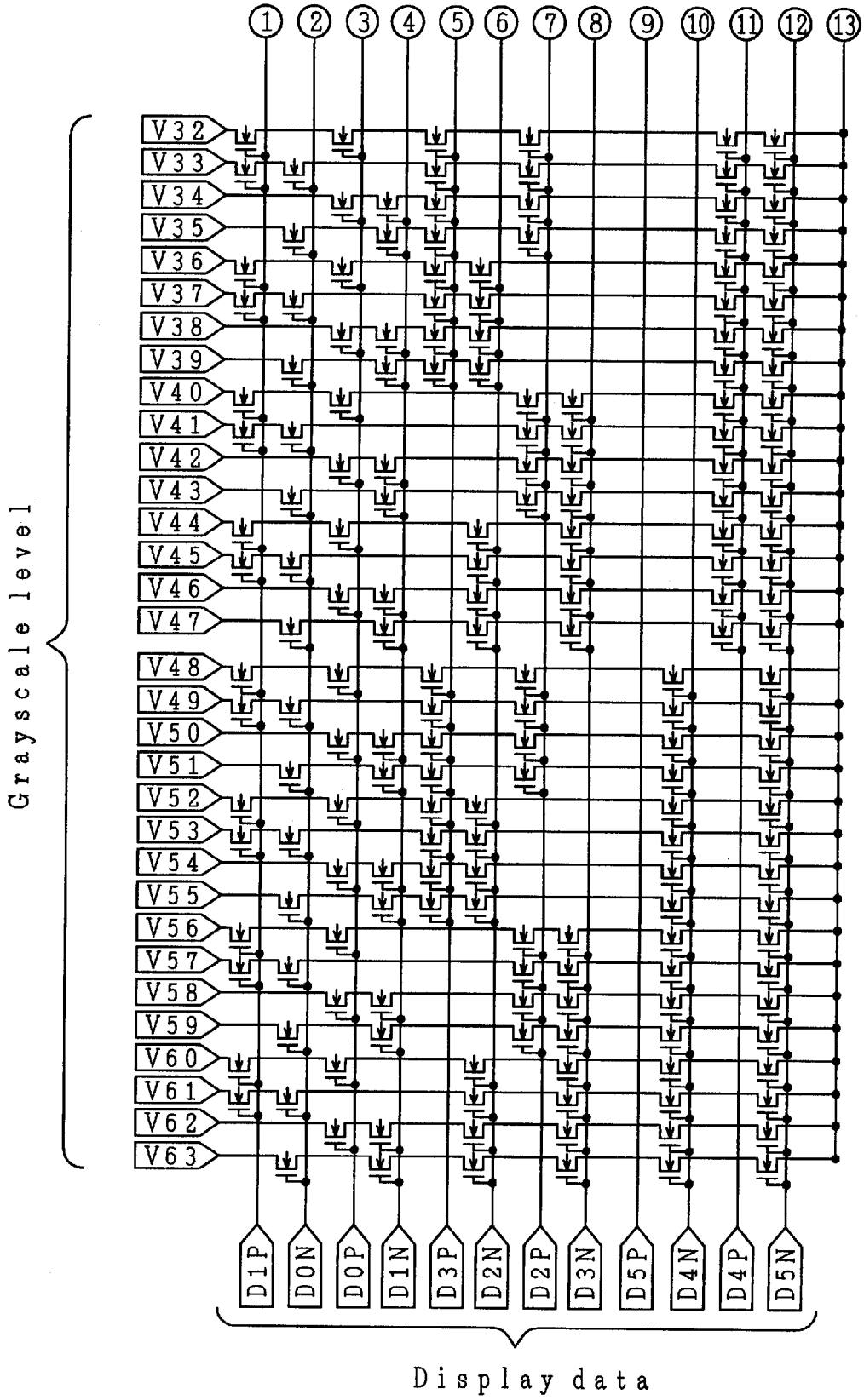
FIG. 34 is a partial circuit diagram constituting one circuit along with FIG. 33 illustrating another specific constructional example of the low-voltage-dedicated circuit of the drain driver.
Figure 35:
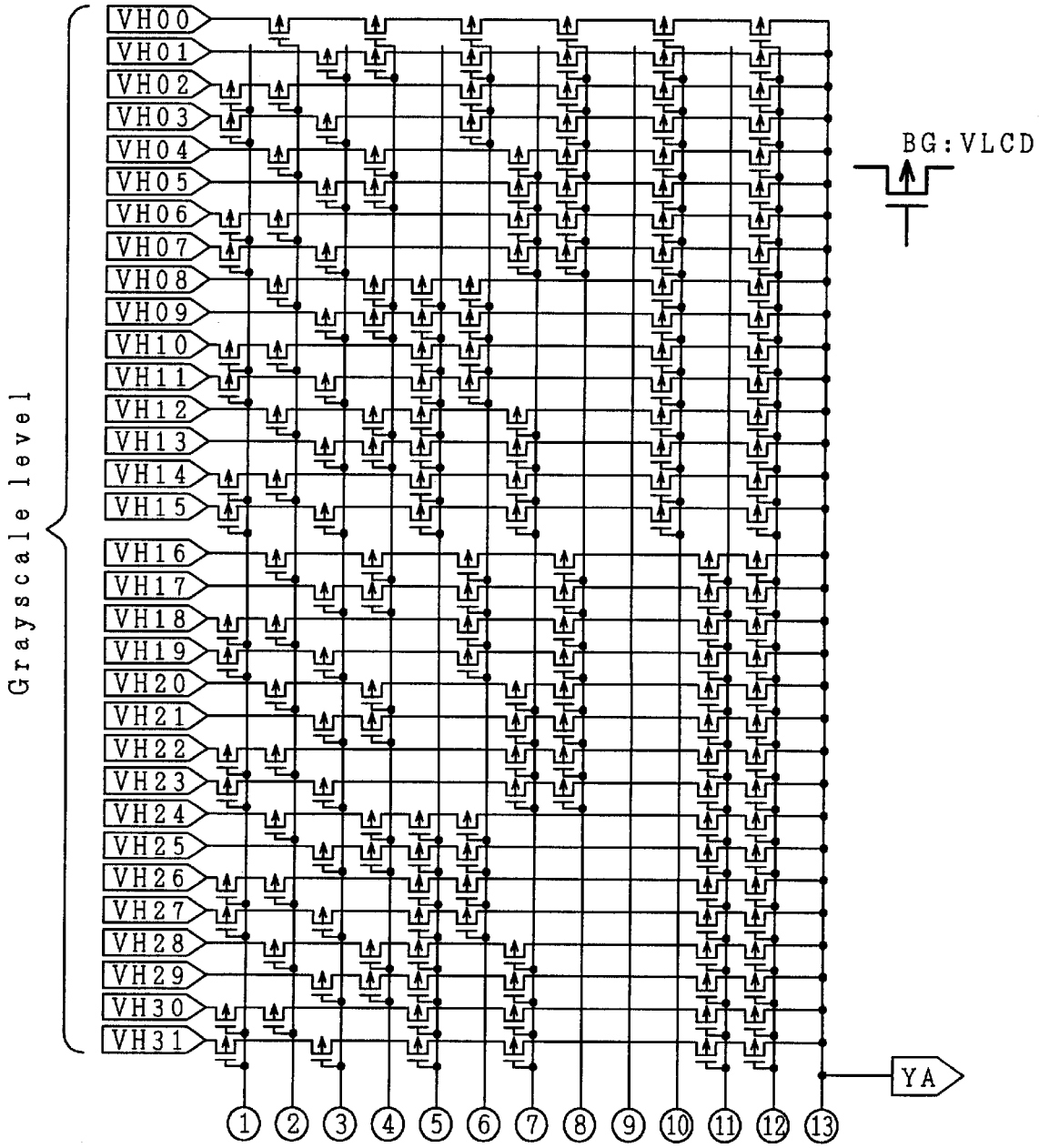
FIG. 35 is a partial circuit diagram illustrating another specific constructional example of the high-voltage-dedicated circuit of the drain driver.
Figure 36:
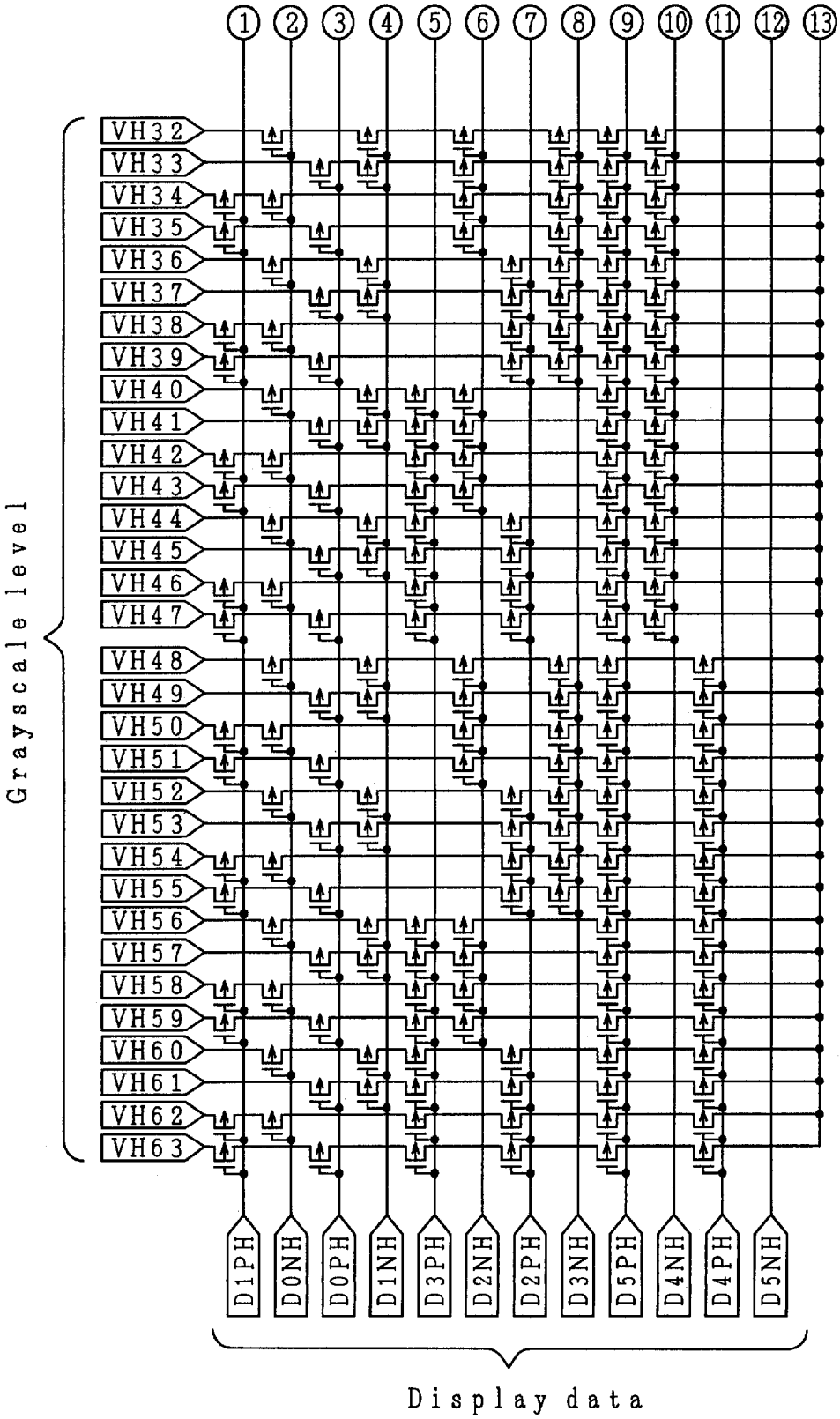
FIG. 36 is a partial circuit diagram constituting one circuit along with FIG. 35 illustrating another specific constructional example of the high-voltage-dedicated circuit of the drain driver.

FIG. 27 is a block diagram illustrating yet another arrangement of a test terminal on, a chip which constitutes the drain driver according to the present invention. In FIG. 27, reference numerals identical to those used in FIG. 25 denote functional portions identical to those shown in FIG. 25.

In the present embodiment, as test terminals for a chopper control signal, a third test terminal 425-3 is arranged on an input terminal side, in addition to a first test terminal 425-1 and a second test terminal 425-2 which are arranged on a liquid crystal driving output terminal side.

In this construction, first of all, during a probe inspection, at the first test terminal 425-1 and the second test terminal 425-2 on the liquid crystal driving output terminal side, an inspection is made as to whether a chopper control signal has reached all the amplifier circuits on a chip, to guarantee that the chopper control signal has reached them.

The third test terminal 425-3 arranged on the input terminal side is led out from the package. On the input terminal side, the wiring density is normally low and it is easy to lead out a test terminal. For this reason, in an inspection after package mounting, the inspection is carried out with the third test terminal 425-3.

According to the present embodiment, even after the step of assembling a package, it is possible to comprehensively inspect and guarantee the frame start signal input and the operation of a chopper signal generation circuit.

Although the present invention has been described above with reference to various embodiments, it is a matter of course that the present invention is not limited to any of the above-described embodiments and various modifications can be made without departing from the spirit of the invention.

Advantages obtained from the representative constructions of the above-described invention will be described below in brief.

(1) It is possible to make maximum output voltage levels for N grayscale levels out of M grayscale levels greater than those for the other (M–N) grayscale levels without the need to increase the chip sizes of drain drivers of a liquid crystal panel which constitutes a liquid crystal display device. Accordingly, it is possible to increase the image quality of the liquid crystal panel and decrease the frame width of the same.

(2) Because the output voltage range of a drain driver becomes wider, it becomes possible to lower liquid crystal driving voltage, so that the power consumption of the entire liquid crystal display device can be decreased.

(3) It is possible to reduce a switchover line area for two different display inputs in a drain driver, and it is also possible to reduce chip size without making the arrangement of input terminal pads different from related-art arrangements, whereby a further reduction in the cost of the liquid crystal display device can be promoted.

(4) It is possible to easily make an inspection as to whether a control signal for a chopper circuit which constitutes a drain driver has reached amplifier circuits at a chip end, and a variation reducing effect on liquid crystal driving voltage becomes sufficient, whereby a further improvement in display quality can be promoted.

(5) With one kind of chip, it is possible to cope with packages whose terminals for frame start signals differ in position, whereby chip development costs and the number of kinds of articles to be produced are reduced and a further reduction in the cost of the liquid crystal display device can be promoted.

(6) In a chip probe inspection and in an inspection after package assembly, even after package assembly, it is possible to make an inspection as to whether a chopper control signal has reached all the amplifier circuits. Accordingly, it is possible to provide a highly reliable liquid crystal display device.

What is claimed is:

1. A liquid crystal display device comprising:

a liquid crystal panel having a plurality of scanning signal lines and a plurality of video signal lines and having a plurality of pixels to which video signal voltages corresponding to A number of pieces of display data are to be applied via the video signal lines by a plurality of video signals; and video signal line driving means for supplying to the video signal lines the video signal voltages corresponding to the A number of pieces of display data, the video signal line driving means having: a power source circuit for outputting K number of grayscale reference voltages; a plurality of grayscale generation circuits for generating grayscale voltages corresponding to the A number of pieces of display data, for the respective video signal lines; and a video signal line driving circuit made of a plurality of amplifier circuits and output selecting circuits for amplifying the grayscale voltages and outputting video signal voltages corresponding to the display data to the respective video signal lines, the video signal lines driving means including: grayscale voltage generation means for dividing the K number of grayscale reference voltages outputted from the power source circuit to generate M-level grayscale voltages and selecting one of the generated grayscale voltages; and output means for making maximum output levels for N grayscale levels out of the M grayscale levels greater than maximum output levels for the other (M−N) grayscale levels, the grayscale voltage generation means being a grayscale voltage selection circuit having switching elements corresponding to the A number of pieces of display data; among switching elements for selecting display data for the N grayscale levels, switching elements corresponding to the B number of pieces of display data among the A number of pieces of display data having the switching characteristics of being turned on or off at all the N grayscale levels, and on-resistances of switching elements corresponding to (A−B) number of pieces of display data being smaller than on-resistances of switching elements for selecting display data for the (M−N) grayscale levels.

2. A liquid crystal display device according to claim 1, characterized in that the switching elements corresponding to the B number of pieces of display data are CMOS transistors.

3. A liquid crystal display device according to claim 1, characterized in that threshold voltages of the switching elements corresponding to the (A−B) number of pieces of display data are smaller than threshold voltages of the switching elements for selecting display data for the (M−N) grayscale levels.

4. A liquid crystal display device according to claim 1, characterized in that each of the amplifier circuits includes a switching element for effecting switchover between an input part and an output part, the switching element for effecting switchover between the input part and the output part being a switching clement capable of outputting an output level not lower than the maximum output levels for the N grayscale levels.

5. A liquid crystal display device according to claim 4, characterized in that the switching clement for effecting switchover between the input part and the output part is a CMOS transistor.

6. A liquid crystal display device according to claim 1, characterized in that each of the output selection circuits includes a switching element capable of outputting an output level not lower than the maximum output levels for the N grayscale levels.

7. A liquid crystal display device according to claim 6, characterized in that each of the output selection circuits is a CMOS transistor.

* * * * *